US009216876B2

(12) United States Patent
Suzuki

(10) Patent No.: US 9,216,876 B2
(45) Date of Patent: Dec. 22, 2015

(54) PAPER DISCHARGE DEVICE

(71) Applicant: RISO KAGAKU CORPORATION, Minato-ku, Tokyo (JP)

(72) Inventor: Masao Suzuki, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/153,121

(22) Filed: Jan. 13, 2014

(65) Prior Publication Data

US 2014/0197594 A1 Jul. 17, 2014

(30) Foreign Application Priority Data

Jan. 15, 2013 (JP) ..... 2013-004593

(51) Int. Cl.

| | |
|---|---|
| ***B65H 31/04*** | (2006.01) |
| ***B65H 43/06*** | (2006.01) |
| ***B65H 31/10*** | (2006.01) |
| ***B65H 31/20*** | (2006.01) |
| ***B65H 43/00*** | (2006.01) |
| ***G03G 15/00*** | (2006.01) |
| *B65H 31/02* | (2006.01) |

(52) U.S. Cl.

CPC ..... *B65H 43/06* (2013.01); *B65H 31/10* (2013.01); *B65H 31/20* (2013.01); *B65H 43/00* (2013.01); *G03G 15/6552* (2013.01); *B65H 31/02* (2013.01); *B65H 2405/1122* (2013.01); *B65H 2405/15* (2013.01); *B65H 2511/222* (2013.01); *B65H 2511/51* (2013.01); *B65H 2511/528* (2013.01); *B65H 2553/30* (2013.01); *B65H 2801/06* (2013.01); *G03G 2215/00637* (2013.01); *G03G 2215/00911* (2013.01)

(58) Field of Classification Search

CPC ..... B65H 31/10; B65H 2553/30; B65H 9/20; B65H 31/02

USPC ..... 271/214, 215, 217

See application file for complete search history.

(56) References Cited

U.S. PATENT DOCUMENTS

| | | | | |
|---|---|---|---|---|
| 4,229,650 | A * | 10/1980 | Takahashi et al. | 250/223 R |
| 6,289,730 | B1 * | 9/2001 | Elgee | 73/159 |
| 2008/0036139 | A1 * | 2/2008 | Reyner et al. | 271/262 |

FOREIGN PATENT DOCUMENTS

| | | |
|---|---|---|
| JP | 62060757 | 3/1987 |

* cited by examiner

*Primary Examiner* — Howard Sanders

(74) *Attorney, Agent, or Firm* — Greenblum & Bernstein P.L.C.

(57) ABSTRACT

A paper discharge device includes: an end fence to restrict leading end positions of paper sheets discharged to a paper receiving tray; a lift mechanism to lower the paper receiving tray by a prescribed distance upon reach of a top surface position of the paper sheets stacked on the paper receiving tray to a reference position; an ultrasonic sensor to emit an ultrasonic wave in a horizontal direction toward the paper receiving tray from upstream of the paper receiving tray in a discharge direction in a prescribed height range including the reference position and portions above and below the reference position, and receive a reflected wave from a detection target; and a detector to detect the top surface position on a basis of changes in a reception level of the reflected wave over an elapsed time from an emission of the ultrasonic wave.

18 Claims, 20 Drawing Sheets

FIG. 21

| CAPTURED PERIOD | REFLECTED WAVE LEVEL | REFERENCE SIGN | NORMAL STATE (FIG. 19(a)) | ABNORMAL STATE 1 (FIG. 19(b)) | ABNORMAL STATE 2 (FIG. 19(c)) | ABNORMAL STATE 3 (FIG. 19(d)) |
|---|---|---|---|---|---|---|
| PERIOD A | PEAK VALUE | AM_Ap | 8.5 | 8.7 | 8.1 | 8.7 |
| PERIOD B | PEAK VALUE | AM_Bp | 5.7 | 1.9 | 2.3 | 3.5 |
| PERIOD C | PEAK VALUE | AM_Cp | 4.1 | 3.9 | 8.3 | 6.1 |
| PERIOD D | PEAK VALUE | AM_Dp | 2.1 | 2.1 | 3.9 | 5.3 |
| TOTAL OF REFLECTED WAVE LEVELS FROM NORMAL PORTIONS | AM_Ap + AM_Bp | | 14.2 | 10.6 | 10.4 | 12.2 |
| DETERMINATION CRITERION VALUE FOR REFLECTED WAVE LEVELS FROM NORMAL PORTIONS | NORMAL > | 12 | OK | NG | NG | OK |
| TOTAL OF REFLECTED WAVE LEVELS FROM PARTICULAR PORTIONS | AM_Cp + AM_Dp | | 6.2 | 6 | 12.2 | 11.4 |
| DETERMINATION CRITERION VALUE FOR REFLECTED WAVE LEVELS FROM PARTICULAR PORTIONS | NORMAL < | 10 | OK | OK | NG | NG |
| OVERALL DETERMINATION RESULT | | | NORMAL OPERATION | JAM OCCURS | JAM OCCURS | JAM OCCURS |

AM_ABp [V] = −14 [V]
H1 OBTAINED FROM AM_ABp [V] = −8 [mm]

AM_ABp [V] = −4.5 [V]
H1 OBTAINED FROM AM_ABp [V] = −2 [mm]

AM_ABp [V] = 7.5 [V]
H1 OBTAINED FROM AM_ABp [V] = −2.5 [mm]

AM_ABp [V] = 1.1 [V]
H1 OBTAINED FROM AM_ABp [V] = ±0 [mm]

PAPER DISCHARGE DEVICE

CROSS REFERENCE TO RELATED APPLICATION

This application is based upon and claims the benefit of priority from the prior Japanese Patent Application No. 2013-004593, filed on Jan. 15, 2013, the entire contents of which are incorporated herein by reference.

BACKGROUND

1. Technical Field

The present invention relates to a paper discharge device configured to discharge printed paper sheets.

2. Related Art

As one of paper discharge devices configured to discharge paper sheets printed by printing devices, Japanese Patent Application Publication No. Sho 62-60757 proposes a paper discharge device including a paper receiving tray capable of lifting up and down.

This paper discharge device performs control of maintaining a constant height position of a top surface of stacked paper sheets by lowering the paper receiving tray along with an increase of the stacked paper sheets on the paper receiving tray. Specifically, such a paper discharge device lowers the paper receiving tray when a sensor detects that the paper sheets on the paper receiving tray are stacked up to a reference top surface position. Thus, the paper discharge device can achieve an excellent alignment performance for the discharged paper sheets by maintaining a substantially constant relationship in height between a discharge unit of the printing device from which the paper sheets are dropped to the paper receiving tray and the top surface of the paper sheets stacked on the paper receiving tray.

SUMMARY

In the paper discharge device described above, the following case is conceivable. When a paper sheet is jammed in a top portion of the stacked paper sheets on the paper receiving tray, the sensor erroneously detects the jammed paper sheet as the top surface of the stacked paper sheets and the paper receiving tray is erroneously lowered. Moreover, when the discharge of the paper sheets is continued after the occurrence of jam, the jam may become more serious. Accordingly, providing sensors in the paper discharge device is important for purposes other than detecting the top surface of the stacked paper sheets on the paper receiving tray.

Thus, the paper discharge device needs to be provided with multiple sensors not only to detect the top surface of the stacked paper sheets on the paper receiving tray but also to judge the occurrence of a jam. In a paper discharge device for a printing device configured to print many paper sheets at a high speed, particularly, a fence movable depending on the size of paper sheets is used to align the paper sheets on the paper receiving tray while the paper sheets are discharged at a high speed. Accordingly, a sensor needs to be provided also around this fence.

Moreover, each of the sensors is required to detect an appropriate portion of each paper sheet at an appropriate timing corresponding to the arrangement position of the sensor, in a period until the paper sheet is stacked on the paper receiving tray after leaving the discharge unit. To this end, the paper discharge device needs to achieve control for acquiring an output signal from each sensor at an appropriate timing corresponding to the sensor and to employ a complicated configuration in which the sensors are arranged to be capable of detecting the appropriate portions of the paper sheet.

An object of the present invention is to provide a paper discharge device capable of correctly and appropriately detecting a situation of a top surface position of the stacked paper sheets on the paper receiving tray in simple control by using few sensors.

A paper discharge device in accordance with some embodiments includes: a paper receiving tray on which discharged paper sheets are stacked; an end fence configured to restrict leading end positions of the paper sheets discharged to the paper receiving tray; a lift mechanism configured to lower the paper receiving tray by a prescribed distance upon reach of a top surface position of the paper sheets stacked on the paper receiving tray to a reference position; an ultrasonic sensor configured to emit an ultrasonic wave in a horizontal direction toward the paper receiving tray from upstream of the paper receiving tray in a discharge direction of the paper sheets in a prescribed height range including the reference position and portions above and below the reference position, and to receive a reflected wave from a detection target; and a detector configured to detect the top surface position on a basis of changes in a reception level of the reflected wave over an elapsed time from an emission of the ultrasonic wave.

In the configuration described above, when the top surface position of the stacked paper sheets on the paper receiving tray is near the reference position, the reflected waves of the ultrasonic wave emitted by the ultrasonic sensor in the horizontal direction in the prescribed height range including the reference position reach the ultrasonic sensor from the trailing end of the stacked paper sheets in the discharge direction below the reference position and from the end fence above the reference position.

Moreover, since the round-trip distance from the ultrasonic sensor to the trailing end of the stacked paper sheets and that to the end fence are different from each other, the reflected waves of the ultrasonic wave return to the ultrasonic sensor at different timings. Accordingly, the reflected wave from the trailing end of the stacked paper sheets and the reflected wave from the end fence are detected by the ultrasonic sensor at different time positions at levels corresponding to areas of reflection of the ultrasonic wave, respectively.

Accordingly, the situation of the top surface position of the stacked paper sheets on the paper receiving tray can be correctly and appropriately detected in simple control only by receiving the reflected waves of the ultrasonic wave with one ultrasonic sensor and detecting a boundary between the trailing end of the stacked paper sheets and the end fence as the top surface position of the stacked paper sheets, the ultrasonic wave emitted by the ultrasonic sensor in the horizontal direction in the prescribed height range including the reference position and portions above and below the reference position.

The detector may be further configured to detect a distribution of positions of the detection target in the horizontal direction in the prescribed height range on a basis of the changes in the reception level of the reflected wave over the elapsed time from the emission of the ultrasonic wave, and determine whether a jam occurs in the paper sheets stacked on the paper receiving tray on a basis of the detected distribution.

In the configuration described above, a portion where the ultrasonic wave is blocked by a jammed paper sheet occurs when a jam occurs in the stacked paper sheets on the paper receiving tray. Accordingly, the distribution of the level of the reflected wave, as well as the distribution of the positions of the detection target in the horizontal direction which corresponds to the size of the reflected wave, changes in a portion above the top surface position of the stacked paper sheets.

Whether a jam occurs or not can be thus appropriately detected based on the distribution of the positions of the detection target in the horizontal direction in the portion above the top surface position of the stacked paper sheets, by determining the distribution of the level of the reflected wave received by the same ultrasonic sensor as that used for the detection of the top surface position of the stacked paper sheets.

The detector may be configured to determine that the jam occurs in the paper sheets stacked on the paper receiving tray when at least one of the positions of the detection target in the horizontal direction is distributed between a trailing end position of the paper sheets stacked on the paper receiving tray and the end fence in the prescribed height range.

In the configuration described above, when a jam occurs in the stacked paper sheets on the paper receiving tray, the detection target reflecting the ultrasonic wave exists upstream of the end fence in the portion above the top surface position of the stacked paper sheets, due to the jammed paper sheet.

Accordingly, whether a jam occurs in the stacked paper sheets can be appropriately detected based on the determination of whether the detection target reflecting the ultrasonic wave is distributed in the portion between the trailing end of the stacked paper sheets and the end fence in the discharge direction, by determining the distribution of the level of the reflected wave received by the same ultrasonic sensor as that used for the detection of the top surface position of the stacked paper sheets.

The paper discharge device may further include a notification unit configured to output a jam notification signal for stopping discharge of the paper sheets, to a printing device configured to discharge the paper sheets onto the paper receiving tray, when the detector determines that the jam occurs in the paper sheets stacked on the paper receiving tray.

In the configuration described above, in a state where a jam occurs in the stacked paper sheets on the paper receiving tray, a newly-discharged paper sheet makes the jam more serious. Thus, the occurrence of jam is notified to the printing device to stop the printing operation of the printing device and stop the discharge of the new paper sheet. Hence, the jam can be prevented from becoming more serious.

The paper discharge device may further include a reflection plate arranged on routes of the ultrasonic wave and the reflected wave, and the ultrasonic sensor may be configured to use the reflection plate to emit the ultrasonic wave in the horizontal direction toward the paper receiving tray from upstream of the paper receiving tray in the discharge direction of the paper sheets in the prescribed height range and to receive the reflected wave from the detection target.

In the configuration described above, the routes of the ultrasonic wave and reflected wave can be extended without arranging the ultrasonic sensor away from the detection target, by reflecting the ultrasonic wave and the reflected wave with the reflection plate and thereby changing directions thereof in the middle of the route. Hence, the ultrasonic sensor which has no function of cancelling out diffracted waves and in which the shortest detection range is long can be used without increasing the size of the device.

Note that, as a paper discharge device according to a first modification example, the paper discharge device described above may be configured as follows. The ultrasonic sensor outputs the ultrasonic wave by being driven by a signal to which a brake pulse is added in such a way that the reception of the reflected wave from the trailing end position of the stacked paper sheets can be completed before the start of the reception of the reflected wave from the end fence.

In the paper discharge device of the first modified example, when the stacked paper sheets are paper sheets with a short dimension between the leading and trailing ends thereof like, for example, "post cards", the round-trip distance from the ultrasonic sensor to the trailing end of the stacked paper sheets and that to the end fence are not so different from each other. In such a case, the reception level of the reflected wave from the end fence starts to increase before the reception level of the reflected wave from the trailing end of the stacked paper sheets completely decreases, and the reflected waves may interfere with each other.

When the preceding reflected wave from the trailing end of the stacked paper sheets interferes with the subsequent reflected wave from the end fence, particularly, the reception level of the subsequent reflected wave from the end fence cannot be accurately detected and the position detection accuracy of the end fence in the horizontal direction deteriorates.

To solve this problem, the signal to which the brake pulse is added is used to drive the ultrasonic sensor to reduce an excitation vibration period of the ultrasonic wave transmitting element and accelerate attenuation of the ultrasonic wave or the reflected wave. The reflected wave from the trailing end of the stacked paper sheets and the reflected wave from the end fence are thus made not to interfere with each other. Hence, it is possible to detect the reception level of the subsequent reflected wave from the end fence at a high accuracy and accurately detect the position of the end fence in the horizontal direction.

Moreover, as a paper discharge device of a second modified example, the paper discharge device described above may be configured as follows.

The ultrasonic sensor is configured to emit the ultrasonic wave from a transmitting element for transmitting the ultrasonic wave via a transmitting horn, and to receive the reflected wave from the detection target with a receiving element via a receiving horn.

The transmitting horn and the receiving horn respectively have horn enclosures identical to each other.

Each of the horn enclosures has two acoustic horn bodies in which positions of openings of the acoustic horn bodies are shifted from each other in the horizontal direction by an interval ΔLh shown below, provided that the wavelength of the ultrasonic wave is λ, and whose dimensions in the horizontal direction differ by the interval ΔLh:

$$\Delta Lh=\lambda\times\{n+(1/4)\}$$

(where n is an integer equal to or larger than 0)

The two acoustic horn bodies are partitioned from each other on the side close to the openings by a screen for the respective acoustic horn bodies, and communicate with each other on the side close to the transmitting element and the receiving element to form a common acoustic space.

In the paper discharge device of the second modified example, the ultrasonic wave transmitted from the transmitting element in the paper discharge device propagates through the two acoustic horn bodies after passing through the common acoustic space of the horn enclosure of the transmitting horn, and are transmitted toward the detection target from the openings shifted from each other in the horizontal direction by $\lambda\times\{n+(1/4)\}$. At this time, part of the ultrasonic wave is diffracted at the openings of the respective acoustic horn bodies and turns into diffracted waves. The diffracted waves generated at the openings of the acoustic horn bodies of the transmitting horn are diffracted at the openings of the acoustic horn bodies of the receiving horn and propagate toward the common acoustic space of the receiving horn.

Incidentally, in the acoustic horn bodies of each horn enclosure, the positions of the openings are shifted from each other in the horizontal direction by $\lambda\times\{n+(1/4)\}$ (where n is an integer equal to or larger than 0). Thus, the dimensions of the respective acoustic horn bodies in the propagating direction also differ from each other by $\lambda\times\{n+(1/4)\}$ (where n is an integer equal to or larger than 0). Accordingly, the propagation distance of the diffracted wave which is generated at the opening of the acoustic horn body of the transmitting horn with the shorter dimension and which is then diffracted at the opening of the acoustic horn body of the receiving horn with the shorter dimension to travel toward the common acoustic space is shorter than the propagation distances of diffracted waves travelling through different routes by $2\times\lambda\times\{n+(1/4)\}$ (where n is an integer equal to or larger than 0). Here, the different routes include a route through the acoustic horn body of the transmitting horn with the shorter dimension and the acoustic horn body of the receiving horn with the longer dimension, a route through the acoustic horn body of the transmitting horn with the longer dimension and the acoustic horn body of the receiving horn with the shorter dimension, and a route through the acoustic horn body of the transmitting horn with the longer dimension and the acoustic horn body of the receiving horn with the longer dimension.

As described above, since the two diffracted waves whose propagation distances differ by $2\times\lambda\times\{n+(1/4)\}$ are sound waves with opposite phases shifted by a half-wave length, the diffracted waves interfere with each other and are attenuated upon reaching the common acoustic space of the horn enclosure of the receiving horn. Accordingly, the diffracted wave generated at the openings of the transmitting horn can be attenuated in the state of the sound pressure in the common acoustic space of the receiving horn, before being received by the receiving element. Hence, it is possible to suppress deterioration in the detection accuracy of the detection target. Particularly, setting the diffracted waves of the respective propagation distances to have substantially the same level of amplitude can cancel out the diffracted waves and prevent deterioration in the detection accuracy of the detection target.

Forming the horn enclosure of each of the transmitting horn and the receiving horn with the two acoustic horn bodies in which the positions of the openings are different can generate the diffracted waves with opposite phases and different propagation distances and make the diffracted waves attenuate each other. Accordingly, there is no need to provide an interval between the openings of the transmitting horn and the receiving horn. Thus, the deterioration in the detection accuracy due to the effects of the diffracted wave can be suppressed without the transmitting horn and the receiving horn being spaced away from each other. Hence, the distance to the detection target at a close distance and the presence and absence of the detection target can be accurately detected without increasing the closest detection range.

Due to this configuration, there is no need to arrange the ultrasonic sensor away from the paper receiving tray by a considerable distance to enable detection of (the trailing end of the stacked paper sheets on) the paper receiving tray, as in an ultrasonic sensor which has a detectable range including no close distance regions, and an increase in size of the device due to restrictions in the arrangement of the ultrasonic sensor can be avoided.

As a modified example of the paper discharge device of the second modified example, the horn enclosures can be configured such that the positions of the screens relative to at least one of the transmitting element and the receiving element can be changed in a plane extending in an up-down direction orthogonal to the horizontal direction.

In such a configuration, when at least one of the position of the screen of the transmitting horn relative to the transmitting element and the position of the screen of the receiving horn relative to the receiving element is changed in the plane orthogonal to the propagating direction of the ultrasonic wave and the reflected wave, the opposing amount (opposing area) between each of the openings of the acoustic horn bodies of the transmitting horn and a corresponding one of the openings of the acoustic horn bodies of the receiving horn changes. Then, the volumes of the diffracted waves reaching the openings of the acoustic horn bodies of the receiving horn from the openings of the acoustic horn bodies of the transmitting horn change, and the amplitudes of the diffracted waves reaching the common acoustic space of the receiving horn in opposite phases change.

Accordingly, it is possible to easily achieve an environment in which the amplitudes of the diffracted waves reaching the common acoustic space of the receiving horn in opposite phases are made to equal to each other and the diffracted waves are thereby cancelled out upon interfering with each other in the common acoustic space.

Moreover, in the paper discharge device of the second modified example and the modified example thereof, each of the common acoustic spaces may have a dimension equal to or larger than $\lambda/2$ in the propagating direction.

In this configuration, a space volume sufficient for the two diffracted waves reaching the common acoustic space of the receiving horn in opposite phases to interfere with each other can be secured in the paper discharge device of the second modified example and the modified example thereof. Hence, attenuation or cancellation of the diffracted waves in the sound pressure state can be more surely achieved.

In the configuration described above, a situation at a top surface position of the stacked paper sheets on the paper receiving tray can be correctly and appropriately detected in simple control by using few sensors.

BRIEF DESCRIPTION OF DRAWINGS

FIG. 21 is an explanatory view showing contents used in determination of the top surface position of the stacked paper sheets and occurrence of jam which is performed by the determination operation instructing unit of FIG. 16.

FIG. 24A is employed.

DETAILED DESCRIPTION

Figure 1:
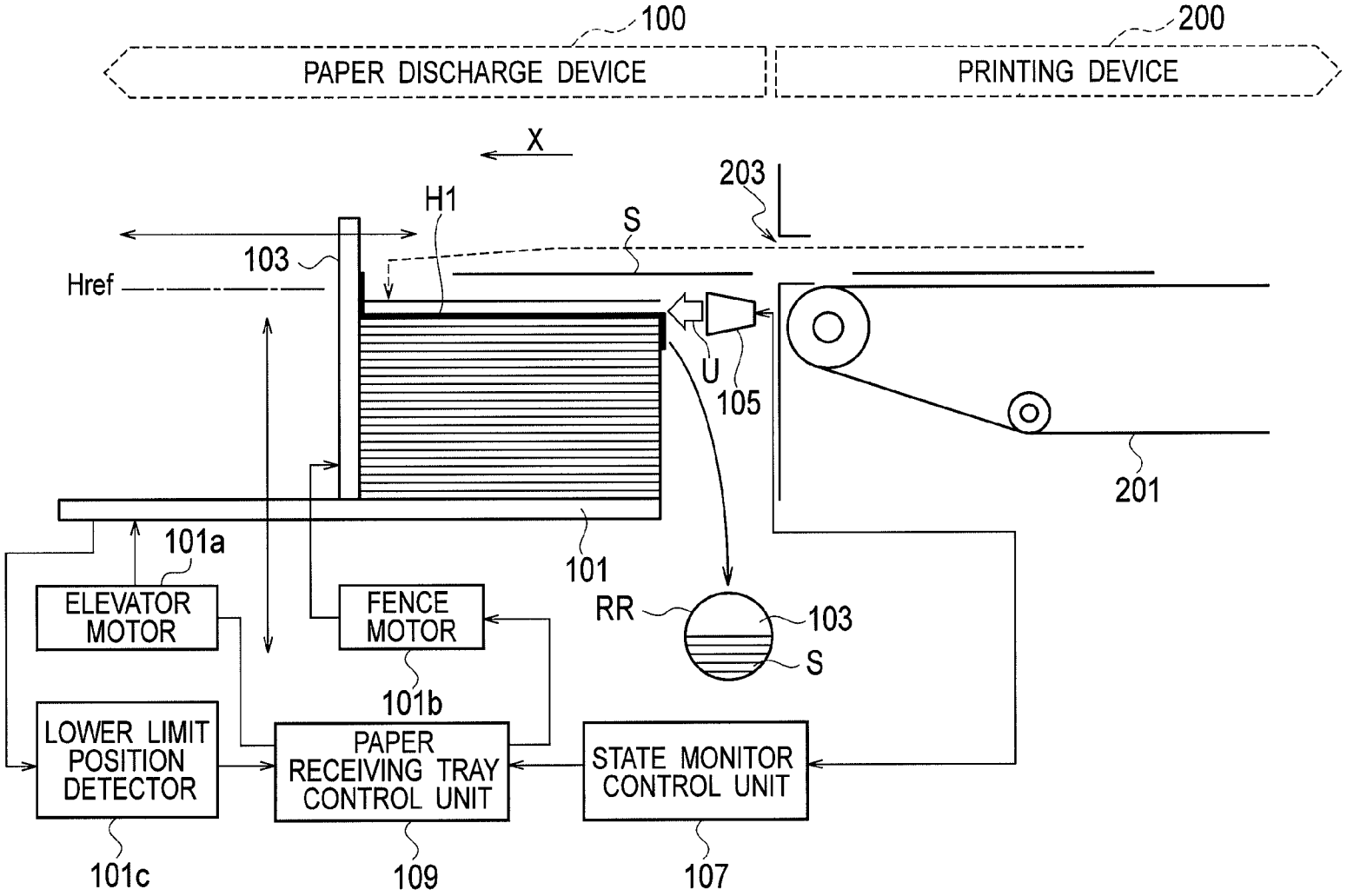
FIG. 1 is a schematic view showing a schematic configuration of a paper discharge device in one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An embodiment of the present invention is described below with reference to the drawings.

FIG. 1 is a schematic view showing a schematic configuration of a paper discharge device in one embodiment of the present invention. As shown in FIG. 1, the paper discharge device 100 of the embodiment is used by being connected to a discharge port 203 from which printed paper sheets S transferred by a belt platen 201 of a printing device 200 are discharged. The paper discharge device 100 includes a paper receiving tray 101, an end fence 103, an ultrasonic sensor 105, a state monitor control unit 107, and a paper receiving tray control unit 109.

The paper receiving tray 101 is a tray on which the paper sheets S discharged from the discharge port 203 of the printing device 200 are stacked. When a top surface position H1 of the paper sheets S (stacked paper sheets) stacked on the paper receiving tray 101 rises to a reference position Href, the paper receiving tray 101 is lowered by a prescribed distance by a power transmitted from an below-mentioned elevator motor 101*a* via a not-illustrated lift mechanism including a known rack-and-pinion mechanism.

The reference position Href is set to a height position appropriate for each paper sheet S to free fall on the stacked paper sheets S on the paper receiving tray 101 and be appropriately aligned with and stacked on the stacked paper sheets S, the each sheet S discharged from the discharge port 203 and hitting the end fence 103. In the embodiment, the reference position Href is set to a height about 50 mm below the height of the discharge port 203 by which the discharged paper sheet S falls until hitting the end fence 103.

The end fence 103 is provided on a top face of the paper receiving tray 101. A leading end of each paper sheet S discharged from the discharge port 203 of the printing device 200 and flying in a discharge direction X hits the end fence 103 and the paper sheet S falls on the paper receiving tray 101. In other words, the end fence 103 causes the discharged paper sheets S to be stacked on the paper receiving tray 101 with the leading end positions of the paper sheets S in the discharge direction X aligned. The position of the end fence 103 in the discharge direction X can be moved by a fence motor 101*b* to be described later, depending on the size and direction (vertical or horizontal) of the paper sheets S to be discharged.

The ultrasonic sensor 105 is fixedly arranged closer to the sheet discharge port 203 of the printing device 200 than the paper receiving tray 101 is. The ultrasonic sensor 105 emits an ultrasonic wave for distance measurement in a horizontal direction (discharge direction X) toward the paper receiving tray 101 in a prescribed height range including the aforementioned reference position Href of the top surface position H1 of the paper sheets S and portions above and below the reference position Href, and receives a reflected wave from a detection target. The prescribed height range includes a position lower than the reference position Href by a prescribed distance. Accordingly, the top surface position H1 of the stacked paper sheets S exists in the prescribed height range in which the ultrasonic wave is emitted, even at a time immediately after the aforementioned lowering of the paper receiving tray 101 by the prescribed distance.

The state monitor control unit 107 drives the ultrasonic sensor 105 and detects occurrence of jam and the top surface position H1 of the stacked paper sheets S on the paper receiving tray 101 on the basis of the distance between the ultrasonic sensor 105 and the detection target in the horizontal direction which is measured from the reflected wave of the ultrasonic wave received by the ultrasonic sensor 105.

The paper receiving tray control unit 109 controls the lifting and lowering drive of the paper receiving tray 101 by the elevator motor 101*a* and the movement of the end fence 103 by the fence motor 101*b* on the basis of detection results of the state monitor control unit 107, an output of a lower limit position detector 101*c*, and the like, the lower limit position detector 101*c* configured to detect that the paper receiving tray 101 is at a lower limit position of a lifting-lowering range which is a home position.

Figure 2:
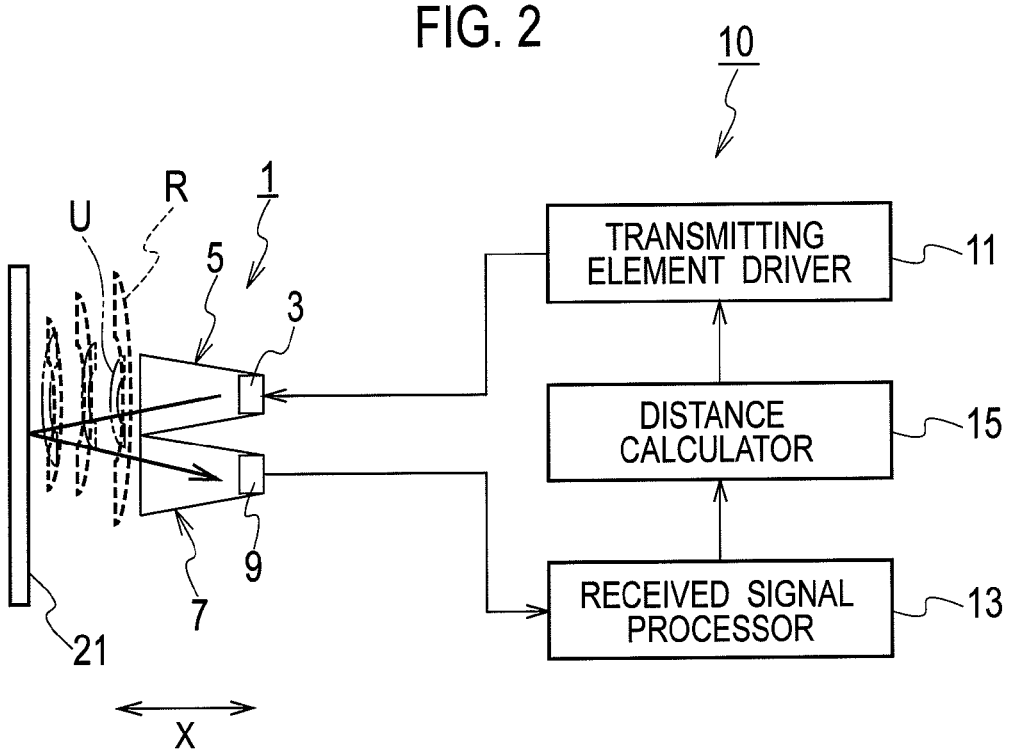
FIG. 2 is an explanatory view showing a schematic configuration of a distance measuring device for a detection target which uses an ultrasonic sensor of FIG. 1.

A description is given of a principle of measuring the distance to the detection target with the ultrasonic sensor 105. FIG. 2 is an explanatory view showing a schematic configuration of a distance measuring device for the detection target which uses the ultrasonic sensor. The distance measuring device shown in FIG. 2 has an ultrasonic sensor 1 and a control unit 10.

The ultrasonic sensor 1 emits an ultrasonic wave U from a transmitting element 3 configured to transmit an ultrasonic wave, toward a detection target 21 via a transmitting horn 5, and receives a reflected wave R from the detection target 21 with a receiving element 9 via a receiving horn 7. The ultrasonic sensor 1 can be used as the ultrasonic sensor 105 of FIG. 1.

The control unit 10 has a transmitting element driver 11 configured to drive the transmitting element 3, a received signal processor 13 configured to process a signal received by the receiving element 9, a distance calculator 15 configured to control the transmitting element driver 11 and the received signal processor 13 and calculate the distance to the detection target 21. The control unit 10 can be used as the state monitor control unit 107 of FIG. 1.

Figure 3:
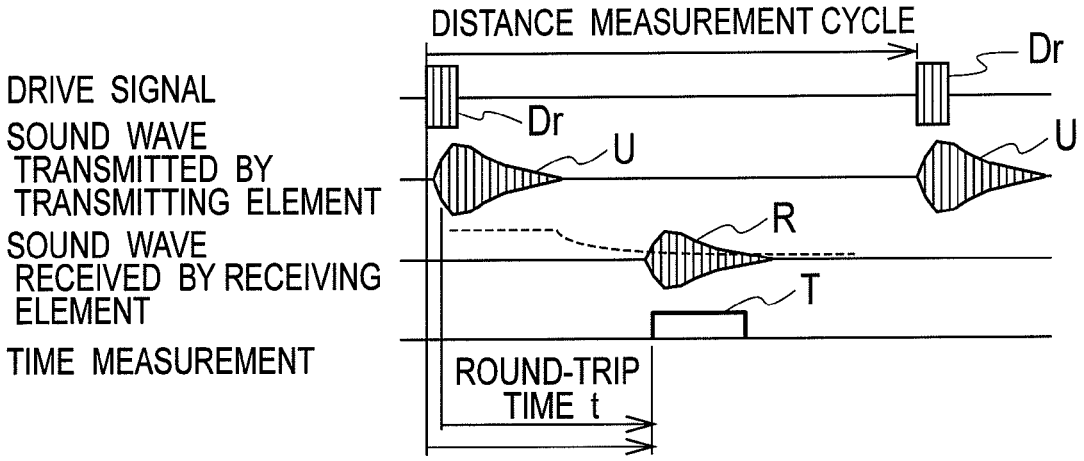
FIG. 3 is a timing chart of signals and sound waves which are generated by the distance measuring device of FIG. 2.

As shown in the timing chart of FIG. 3, for every prescribed distance measurement cycle, the transmitting element driver 11 outputs a drive signal Dr to the transmitting element 3 by being controlled by the distance calculator 15 and the transmitting element 3 driven by the drive signal Dr outputs the ultrasonic wave U. The ultrasonic wave U is reflected from the detection target 21 to turn into the reflected wave R and the reflected wave R is received by the receiving element 9. The receiving element 9 having received the reflected wave R outputs a received signal (not illustrated) to the received signal processor 13. The received signal processor 13 outputs a time measuring signal T to the distance calculator 15 while the received signal is inputted at a level equal to or higher than a prescribed amplitude.

Figure 4:
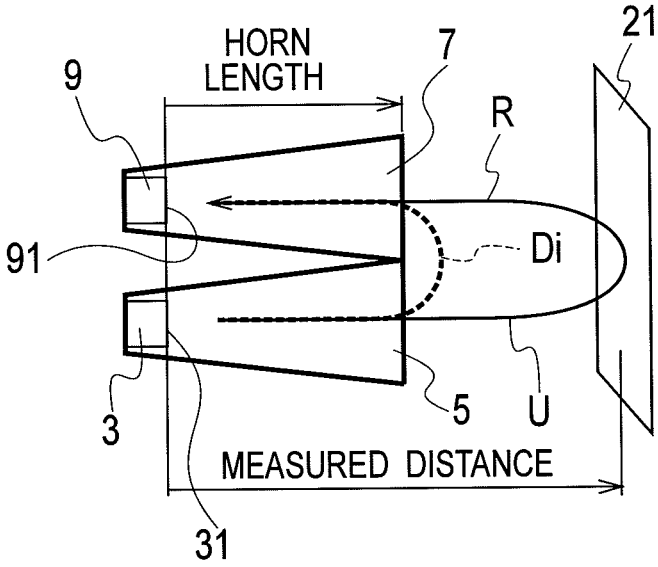
FIG. 4 is an explanatory view conceptually showing a diffracted wave generated in the ultrasonic sensor of FIG. 2.

The distance calculator 15 calculates a time difference between start of output of the ultrasonic wave U by the transmitting element 3 and start of reception of the reflected wave R by the receiving element 9 (start of input of the time measuring signal T to the distance calculator 15), as a round-trip time t from a transmitting surface 31 of the transmitting element 3 to the detection target 21 and to a receiving surface 91 of the receiving element 9 (see FIG. 4 for the surfaces 31, 91). The round-trip time t is multiplied by the speed of sound to calculate a round-trip distance, and the half value of the round-trip distance is obtained as a measurement value of the distance to the detection target 21.

Note that the distance calculator 15 stores, as a known value, a required time from the output of the drive signal Dr by the transmitting element driver 11 to the output of the ultrasonic wave U by the transmitting element 3. Accordingly, the distance calculator 15 can recognize the timing at which the transmitting element 3 has started outputting the ultrasonic wave U, from the required time described above and the timing at which an instruction to output the drive signal Dr is given to the transmitting element driver 11. Moreover, the transmitting surface 31 of the transmitting element 3 and the receiving surface 91 of the receiving element 9 (see FIG. 4 for the surfaces 31, 91) are located on the same plane and the distance calculator 15 measures the distance to the detection target 21 in the normal direction of this plane, i.e. a propagating direction of the ultrasonic wave U and the reflected wave R.

In the ultrasonic sensor 105 used in the paper discharge device 100 of FIG. 1, the discharge direction (horizontal direction) X of the paper sheets S is set to the propagating direction of the ultrasonic wave U and the reflected wave R which are shown in FIG. 2. Accordingly, in the following description, reference sign "X" which is the same as that for the discharge direction of the paper sheets S in the paper discharge device 100 of FIG. 1 is used also for the propagating direction of the ultrasonic wave U and the reflected wave R.

As shown in the explanatory view of FIG. 4, when the ultrasonic wave U transmitted by the transmitting element 3 passes an opening at a front end of the transmitting horn 5, part of the ultrasonic wave U is diffracted at an edge of the opening and turns into a diffracted wave Di. Part of the diffracted wave Di is diffracted again at an opening at a leading end of the receiving horn 7 and travels toward the receiving element 9 together with the reflected wave R from the detection target 21.

Figure 5:
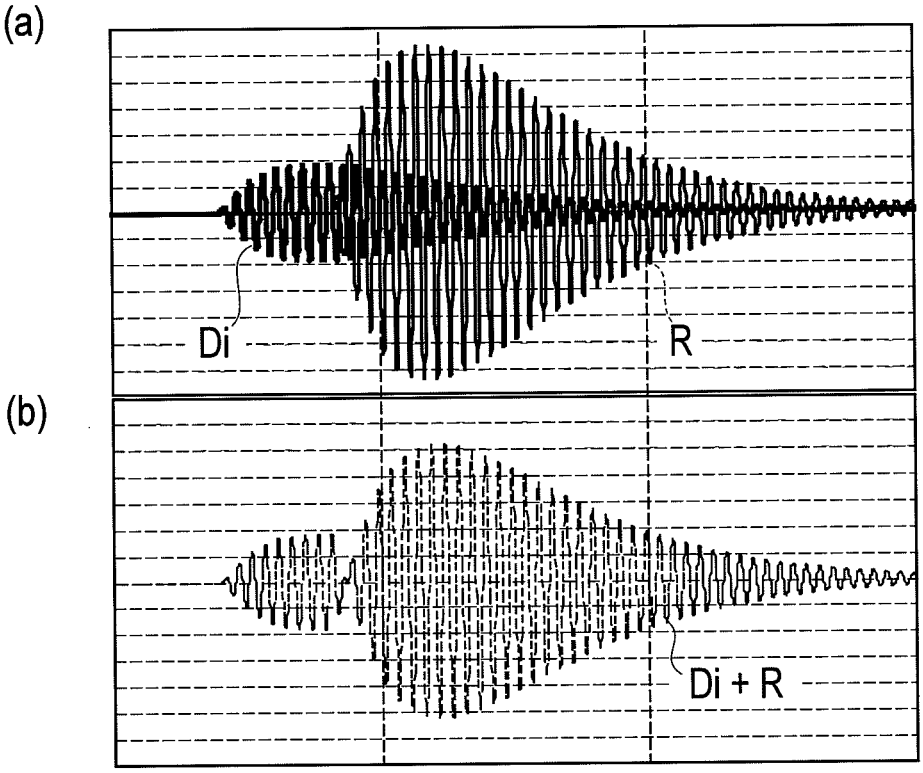
FIGS. 5(*a*) and 5(*b*) show effects of the diffracted wave of FIG. 4 on a process of detecting the detection target, FIG. 5(*a*) is a graph showing the diffracted wave and a reflected wave separately, and FIG. 5(*b*) is a graph showing a combined wave of the diffracted wave and the reflected wave.

When the receiving element 9 receives the diffracted wave Di together with the reflected wave R, the reflected wave R and the diffracted wave Di interfere with each other as shown in the graph of FIG. 5(*a*) and turn into a combined wave (interference wave) which has a waveform different from that of the reflected wave R as shown in the graph of FIG. 5(*b*). Here, since the route of the reflected wave R is longer than that of the diffracted wave Di, the reflected wave R is received by the receiving element 9 after the diffracted wave Di. Accordingly, when a slice level for the amplitude of the combined wave received by the receiving element 9 is set corresponding to the amplitude of the diffracted wave Di, a beginning section of the combined wave in which no components of the reflected wave R is contained can be set as a non-detection period.

Meanwhile, since the amplitude of the combined wave changes depending on a phase difference between the diffracted wave Di and the reflected wave R after amplitude modulation of the reflected wave R by the diffracted wave Di starts due to the interference between the diffracted wave Di and the reflected wave R, a timing at which the amplitude of the combined wave exceeds the slice level is not constant. This causes the detection accuracy of the detection target 21 to deteriorate. Only methods for preventing the diffracted wave Di from entering the receiving element 9 side have been conventionally proposed to solve this problem.

Meanwhile, instead of preventing the diffracted wave Di from entering the receiving element 9 side, the ultrasonic sensor 1 shown in FIG. 2 actively uses the diffracted wave Di in such a way that the receiving element 9 eventually receives only the reflected wave R. Details of this will be apparent in the following description and the ultrasonic sensor 1 can suppress deterioration in the detection accuracy of the detection target 21 at a close distance (interference region) while requiring no complex signal processing described above in which the splice level is set.

Figure 6:
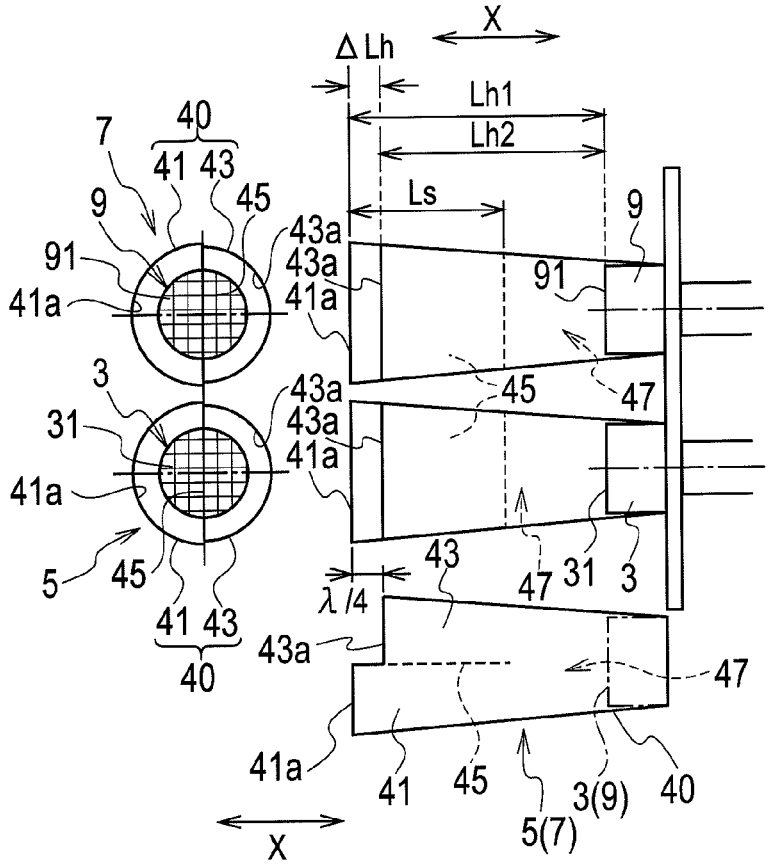
FIG. 6 is an explanatory view showing a schematic configuration of horn enclosures forming a transmitting horn and a receiving horn of the ultrasonic sensor of FIG. 2.

Moreover, in the ultrasonic sensor 1, horn enclosures 40 which have the same shape shown in the explanatory view of FIG. 6 are used as the transmitting horn 5 and the receiving horn 7. Each of the horn enclosures 40 has a substantially truncated cone shape as a whole and includes two acoustic horn bodies 41, 43 which are divided by a plane extending along a center axis direction of the horn enclosure 40 and which have half truncated cone shapes. The acoustic horn body 41 has a horn length of Lh1 in the propagating direction X of the ultrasonic wave U and the reflected wave R while the acoustic horn body 43 has a horn length of Lh2 in the propagating direction X of the ultrasonic wave U and the reflected wave R. There is a dimensional difference of (interval) ΔLh (=Lh1−Lh2) between the acoustic horn bodies 41, 43 in the propagating direction X of the ultrasonic wave U and the reflected wave R. The dimensional difference ΔLh between the acoustic horn bodies 41, 43 are set to a quarter of the wavelength λ of the ultrasonic wave U (λ/4) and the positions of openings 41*a*, 43*a* at front ends of the acoustic horn bodies 41, 43 are shifted from each other by the dimensional difference ΔLh. Note that the dimensional difference ΔLh is not limited to a quarter of the wavelength λ of the ultrasonic wave U (λ/4) and may be any dimension as long as $\Delta Lh=\lambda\times\{n+(1/4)\}$ (where n is an integer equal to or larger than 0) is satisfied.

Portions of the two acoustic horn bodies 41, 43 on a side close to the openings 41*a*, 43*a* are partitioned from each other by a screen 45 and form independent acoustic paths. Moreover, portions of the two acoustic horn bodies 41, 43 on a side close to the transmitting element 3 or the receiving element 9 are not partitioned by the screen 45 and communicate with each other to form a common acoustic space 47.

The horn enclosure 40 of the transmitting horn 5 and the horn enclosure 40 of the receiving horn 7 are attached respectively to the transmitting element 3 and the receiving element 9, which have columnar outer shapes, directly or via substrates. At this time, the horn enclosures 40 are preferably attached to be rotatable in circumferential directions of the transmitting element 3 and the receiving element 9 so that the arrangement of the horn enclosure 40 can be adjusted as described later with reference to FIGS. 11A to 11E and FIGS. 12A to 12E. In the attached state of FIG. 6, the screens 45 of the horn enclosures 40 are aligned in a straight line and the long acoustic horn bodies 41 are arranged on the one side of the screens 45 while the short acoustic horn bodies 43 are arranged on the other side of the screens 45.

Figure 7:
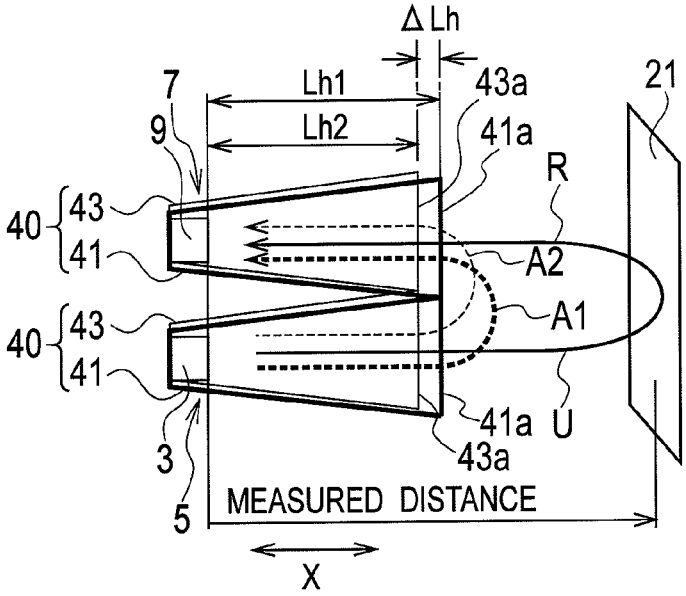
FIG. 7 is an explanatory view specifically showing routes of diffracted waves generated in the ultrasonic sensor of FIG. 2.

In the ultrasonic sensor 1, as shown in the explanatory view of FIG. 7, when the transmitting element 3 to which the horn enclosure 40 is attached as the transmitting horn 5 transmits the ultrasonic wave U, part of the ultrasonic wave U turns into diffracted waves A1, A2 at the openings 41*a*, 43*a* of the acoustic horn bodies 41, 43. Part of the diffracted waves A1, A2 is diffracted again at the openings 41*a*, 43*a* of the horn enclosure 40 attached to the receiving element 9 as the receiving horn 7, and passes through the insides of the acoustic horn bodies 41, 43 toward the common acoustic space 47. In FIG. 7, although the contour of the acoustic horn bodies 41 and the contour of the acoustic horn bodies 43 are shifted from one another in a vertical direction in the drawing for the sake of visibility, the contours actually overlap one another.

The diffracted waves A1, A2 pass through the acoustic horn bodies 41, 43 in which positions of the openings 41*a*, 43*a* are shifted from each other by a quarter of the wavelength λ of the ultrasonic wave U, on each of the transmitting side and the receiving side. Hence, the diffracted waves A1, A2 turn into sound waves with opposite phases shifted by half of the wavelength λ in a round trip.

Figure 8A:
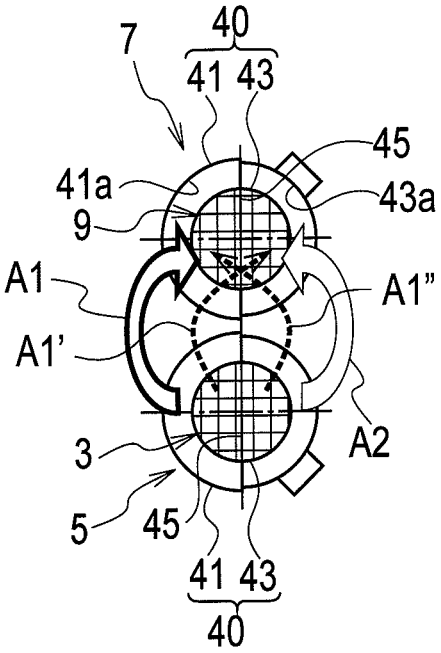
FIG. 8A is an explanatory view showing the volumes of the diffracted waves reaching the acoustic horn bodies on a receiving side of FIG. 6 from the acoustic horn bodies on a transmitting side of FIG. 6.
Figure 9:
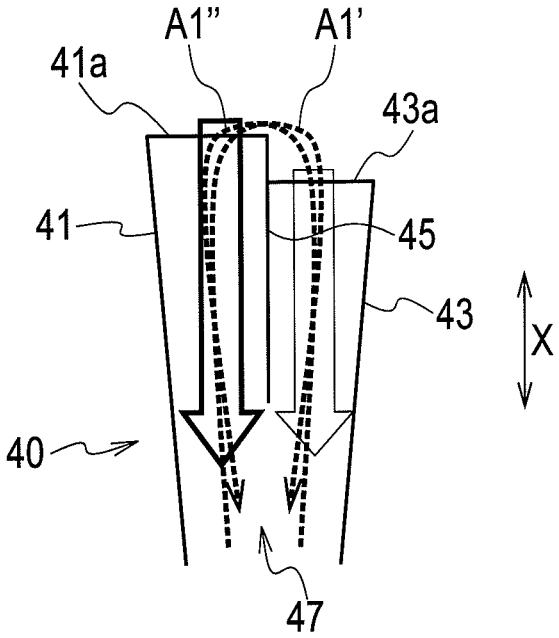
FIG. 9 is an explanatory view showing routes of part of the diffracted waves in FIG. 8A.

As shown in the explanatory view of FIG. 8A, part of the diffracted wave A1 diffracted at the opening 41*a* of the acoustic horn body 41 on the transmitting side is diffracted at the opening 43*a* of the acoustic horn body 43 on the receiving side and turns into a diffracted wave (diffracted wave from the horn with the longer horn length to the horn with the shorter horn length) A1' travelling toward the common acoustic space 47. Similarly, part of the diffracted wave A2 diffracted at the opening 43*a* of the acoustic horn body 43 on the transmitting side is diffracted at the opening 41*a* of the acoustic horn body 41 on the receiving side and turns into a diffracted wave (diffracted wave from the horn with the shorter horn length to the horn with the longer horn length) A1" travelling toward the common acoustic space 47. As shown in the explanatory view of FIG. 9, each of the diffracted waves A1', A1" passes through the acoustic horn body 41 whose dimension in the propagating direction X is long, on the transmitting side or the receiving side. Hence, the phases of the diffracted waves A1', A1" are the same as the phase of the diffracted wave A1 passing through the acoustic horn body 41, on each of the transmitting side and the receiving side. Accordingly, the diffracted waves A1', A1" can be handled together with the diffracted wave A1 in terms of phase.

In the ultrasonic sensor 1, the diffracted wave A1 (as well as the diffracted waves A1', A1") and the diffracted wave A2 with the opposite phases which are diffracted to travel from the horn enclosure 40 on the transmitting side to the horn enclosure 40 on the receiving side are made to interfere with each other in the common acoustic space 47 of the horn enclosure 40 on the receiving side to be attenuated and cancelled out.

Here, the arrangement of the horn enclosures 40, 40 respectively on the transmitting side and the receiving side is described in a simplified manner showing only the routes of the diffracted waves A1, A2 without considering the existence of the diffracted waves A1', A1" in FIG. 8A, in order to simply the description. When the effective acoustic path of the acoustic horn bodies 41 from the transmitting side to the receiving side is symmetrical to the effective acoustic path of the acoustic horn bodies 43 from the transmitting side to the receiving side, the volumes (amplitudes) of the diffracted wave A1 and the diffracted wave A2 are equal to each other.

Figure 8B:
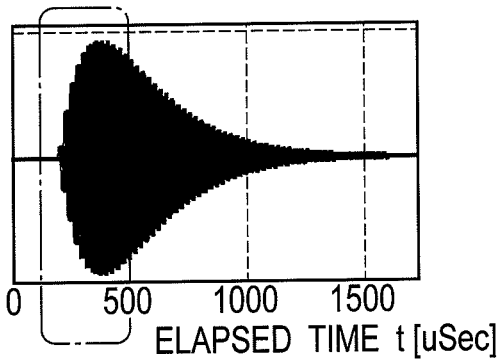
FIG. 8B is a graph showing a relationship between the amplitudes of the diffracted waves in a case where routes are simplified.

In this case, as shown in FIG. 8A, the horn enclosures 40, 40 on the transmitting side and the receiving side are arranged in such a way that an area where the openings 41*a*, 41*a* of the transmitting-side and receiving-side acoustic horn bodies 41, 41 which have the horn length of Lh1 (see FIG. 6) are opposed to each other is equal to an area where the openings 43*a*, 43*a* of the transmitting-side and receiving-side acoustic horn bodies 43, 43 which have the horn length of Lh2 (see FIG. 6) shorter than the horn length L1 are opposed to each other. With this arrangement, the diffracted wave A1 and the diffracted wave A2 with the same amplitude can be obtained as shown in the graph of FIG. 8B.

Figure 10:
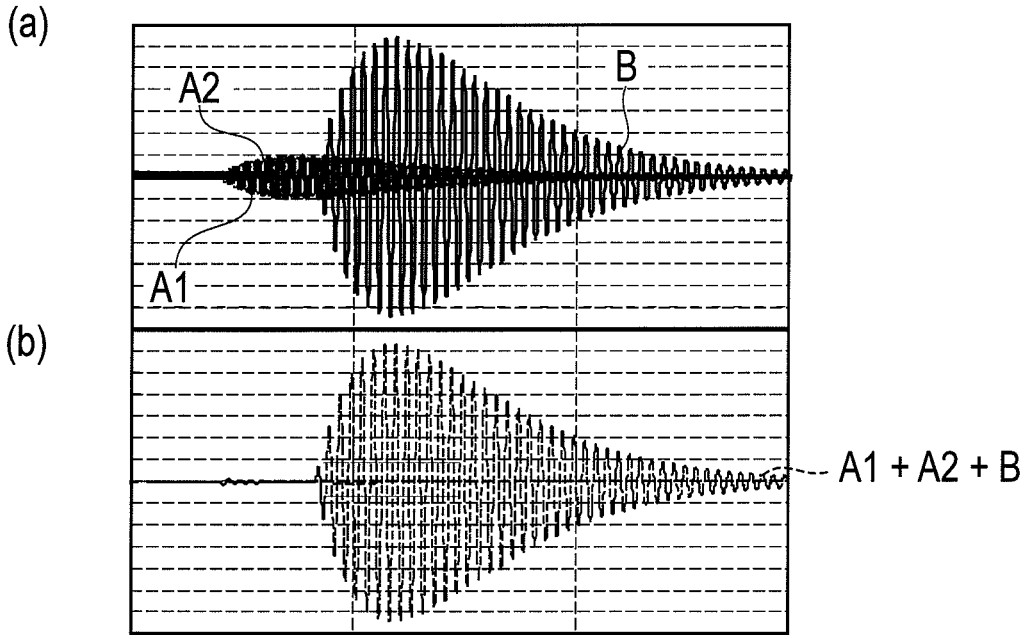
FIGS. 10(*a*) and 10(*b*) specifically show effects of the diffracted waves of the respective routes of FIG. 8A on the process of detecting the detection target, FIG. 10(*a*) is a graph showing the diffracted waves of the respective routes and the reflected wave separately, and FIG. 10(*b*) is a graph showing a combined wave of the diffracted waves and the reflected wave.

When the diffracted wave A1 and the diffracted wave A2 with the same amplitude are obtained, the diffracted waves A1, A2 can be cancelled out as shown in the graph of FIG. 10(*b*) by causing the diffracted waves A1, A2 having opposite phases and having reached the common acoustic space 47 of the horn enclosure 40 on the receiving side to interfere with each other as shown in the graph of FIG. 10(*a*). As a result, only the reflected wave R (B wave in FIG. 10(*a*) and FIG. 10(*b*)) reaches the receiving element 9 and the distance calculator 15 of FIG. 2 can correctly measure the distance to the detection target 21 on the basis of the time measuring signal T from the received signal processor 13.

Figure 11A:
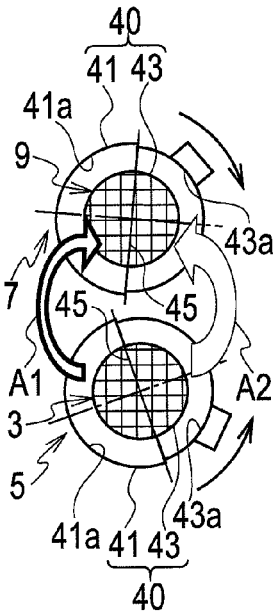
FIG. 11A is an explanatory view showing the volumes of the diffracted waves reaching the acoustic horn bodies on the receiving side from the acoustic horn bodies on the transmitting side when there is a difference in symmetric properties of acoustic paths of the acoustic horn bodies in the horn enclosures of FIG. 6.
Figure 11B:
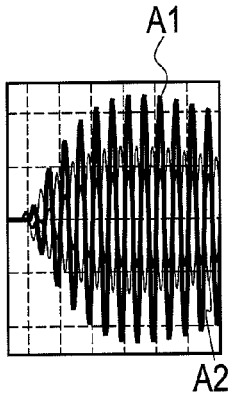
FIG. 11B is a graph showing amplitudes of the respective diffracted waves of FIG. 11A.
Figure 11C:
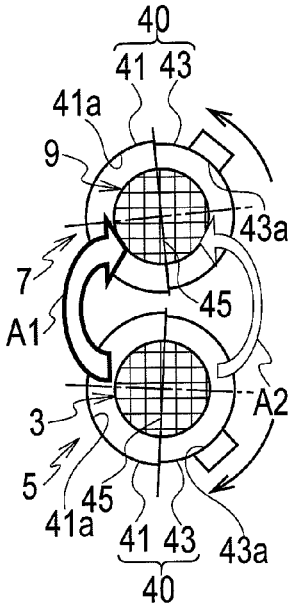
FIG. 11C is an explanatory view showing the volumes of the diffracted waves reaching the acoustic horn bodies on the receiving side from the acoustic horn bodies on the transmitting side when there is a difference in the symmetric properties of the acoustic paths of each acoustic horn body in the horn enclosures of FIG. 6.

Meanwhile, when the effective acoustic path of the acoustic horn bodies 41 from the transmitting side to the receiving side is asymmetrical to the effective acoustic path of the acoustic horn bodies 43 from the transmitting side to the receiving side as shown in FIGS. 11A and 11C, the volumes (amplitudes) of the diffracted wave A1 and the diffracted wave A2 varies from each other. This variation includes a case where "the volume of the diffracted wave A1 is larger than the volume of the diffracted wave A2" and a case where "the volume of the diffracted wave A1 is smaller than the volume of the diffracted wave A2".

In the case where "the volume of the diffracted wave A1 is larger than the volume of the diffracted wave A2", the amplitude of the diffracted wave A1 is larger than the amplitude of the diffracted wave A2 as shown in the graph of FIG. 11B. In this case, as shown in FIG. 11A, the arrangement of the horn enclosures 40, 40 on the transmitting side and the receiving side is adjusted in such away that the area where the openings 43*a*, 43*a* of the transmitting side and the receiving side acoustic horn bodies 43, 43 are opposed to each other is larger than the area where the openings 41*a*, 41*a* of the transmitting side and the receiving side acoustic horn bodies 41, 41 are opposed to each other.

Figure 11D:
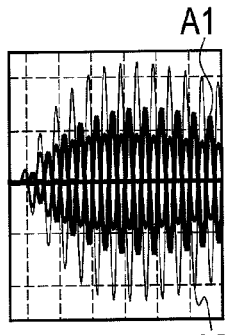
FIG. 11D is a graph showing amplitudes of the respective diffracted waves of FIG. 11C.

In the case where "the volume of the diffracted wave A1 is smaller than the volume of the diffracted wave A2", the amplitude of the diffracted wave A1 is larger than the amplitude of the diffracted wave A2 as shown in the graph of FIG. 11D. In this case, as shown in FIG. 11C, the arrangement of the horn enclosures 40, 40 on the transmitting side and the receiving side is adjusted in such away that the area where the openings 41*a*, 41*a* of the transmitting side and the receiving side acoustic horn bodies 41, 41 are opposed to each other is larger than the area where the openings 43*a*, 43*a* of the transmitting side and the receiving side acoustic horn bodies 43, 43 are opposed to each other.

Figure 11E:
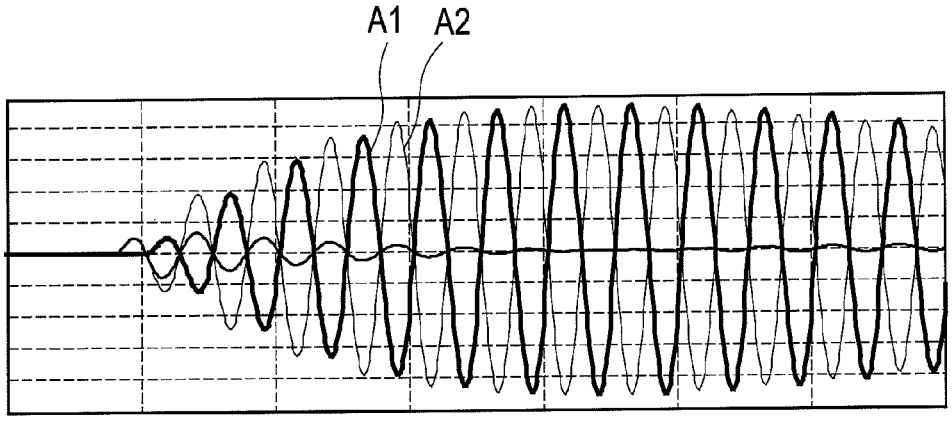
FIG. 11E is a graph showing the amplitudes of the respective diffracted waves of FIGS. 11A and 11C, in a case where the symmetric properties of the acoustic paths are adjusted.

The diffracted wave A1 and the diffracted wave A2 with the same amplitude can be obtained as shown in the graph of FIG. 11E by adjusting the arrangement of the horn enclosures 40, 40 on the transmitting side and the receiving side as described above. Accordingly, the diffracted wave A1 and the diffracted wave A2 are cancel out in the common acoustic space 47 of the horn enclosure 40 on the receiving side and only the reflected wave R reaches the receiving element 9. Hence, the distance calculator 15 of FIG. 2 can correctly measure the distance to the detection target 21.

From the view point of surely achieving cancellation of diffracted waves (diffracted waves A1, A2 in the case of the above description) with opposite phases by interference therebetween in the common acoustic space 47, the dimension (screen length Ls of FIG. 6) of the common acoustic space 47 in the propagating direction X is preferably set to a dimension equal to or larger than a half-wavelength ($\lambda/2$) of the ultrasonic wave U and the reflected wave R.

In the above description, no consideration is made of the existence of the diffracted waves A1', A1" for the sake of description. However, since the volume of the diffracted wave A1 actually increases by the volumes of the diffracted waves A1', A1", the arrangement of the horn enclosures 40, 40 on the transmitting side and the receiving side needs to be determined or adjusted in consideration of a substantive increase amount in amplitude of the diffractive wave A1 due to the diffracted waves A1', A1".

Figure 12A:
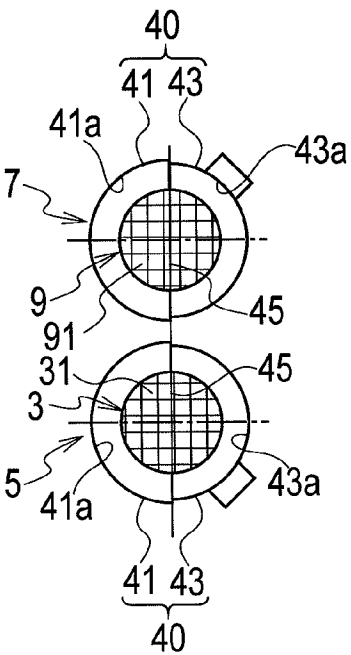
FIGS. 12A to 12E are explanatory views showing adjustment patterns related to the symmetric properties of the acoustic paths of the acoustic horn bodies shown in FIGS. 11A to 11E.
Figure 12B:
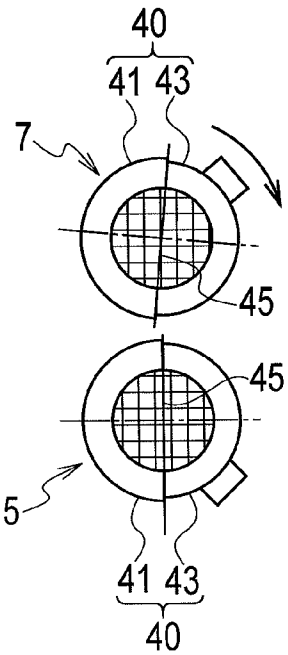
Figure 12C:
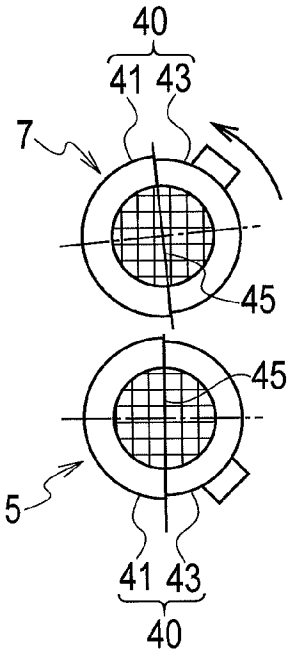
Figure 12D:
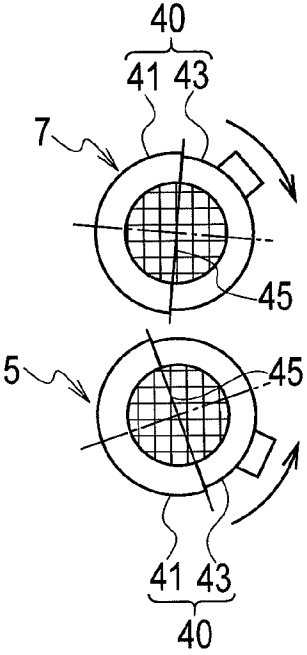
Figure 12E:
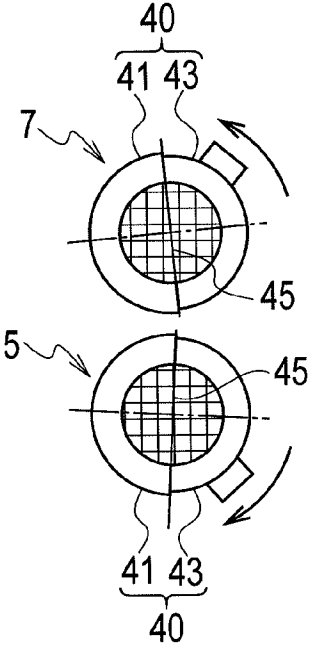

There are several patterns of adjusting the arrangement of the horn enclosures 40, 40 on the transmitting side and the receiving side. For example, patterns of adjusting the arrangement of the horn enclosures 40, 40 on the transmitting side and the receiving side from a default arrangement in which the screens 45 of both horn enclosures 40, 40 are aligned in a straight line as shown in FIG. 12A include: patterns in which only one of the horn enclosures 40 are adjusted as shown in FIGS. 12B and 12C; and patterns in which both of the horn enclosures 40 are adjusted as shown in FIGS. 12D and 12E.

It is only necessary to make the amplitude of the diffracted wave A1 (including the amplitudes of the diffracted waves A1', A1") and the amplitude of the diffracted wave A2 equal to each other by appropriately performing such adjustment.

In the ultrasonic sensor 1 described above, the horn enclosure 40 including the two acoustic horn bodies 41, 43 with the dimensional difference $\Delta$Lh equal to a quarter of the wavelength $\lambda$ of the ultrasonic wave U ($\lambda/4$) in the propagating direction X of the ultrasonic wave U and the reflected wave R is used as the transmitting horn 5 and the receiving horn 7. Moreover, the ultrasonic sensor 1 is configured such that the amplitudes of the diffracted wave A1 (including the diffracted waves A1', A1") and the diffracted wave A2 with opposite phases are made to equal to each other between the transmitting side and the receiving side, and the diffracted waves A1, A2 (including the diffracted waves A1', A1") are thereby cancelled out in the common acoustic space 47 of the horn enclosure 40 which is provided in front of the receiving element 9 and which is not partitioned by the screen 45 for the acoustic horn bodies 41, 43.

Accordingly, there is no need to provide an interval between the opening of the transmitting horn 5 and the opening of the receiving horn 7 (between the openings 41*a* and between the opening 43*a* of the acoustic horn bodies 41, 43 of the horn enclosures 40 on the transmitting side and the receiving side). Hence, deterioration in the accuracy of detecting the distance to the detection target 21 and similar operations due to effects of the diffracted waves A1, A2 (including the diffracted waves A1', A1") can be suppressed without spacing the transmitting horn 5 and the receiving horn 7 away from each other. Specifically, the distance to the detection target 21 at a close distance and presence and absence of the detection target 21 can be accurately detected without increasing the closest detection range.

Figure 13:
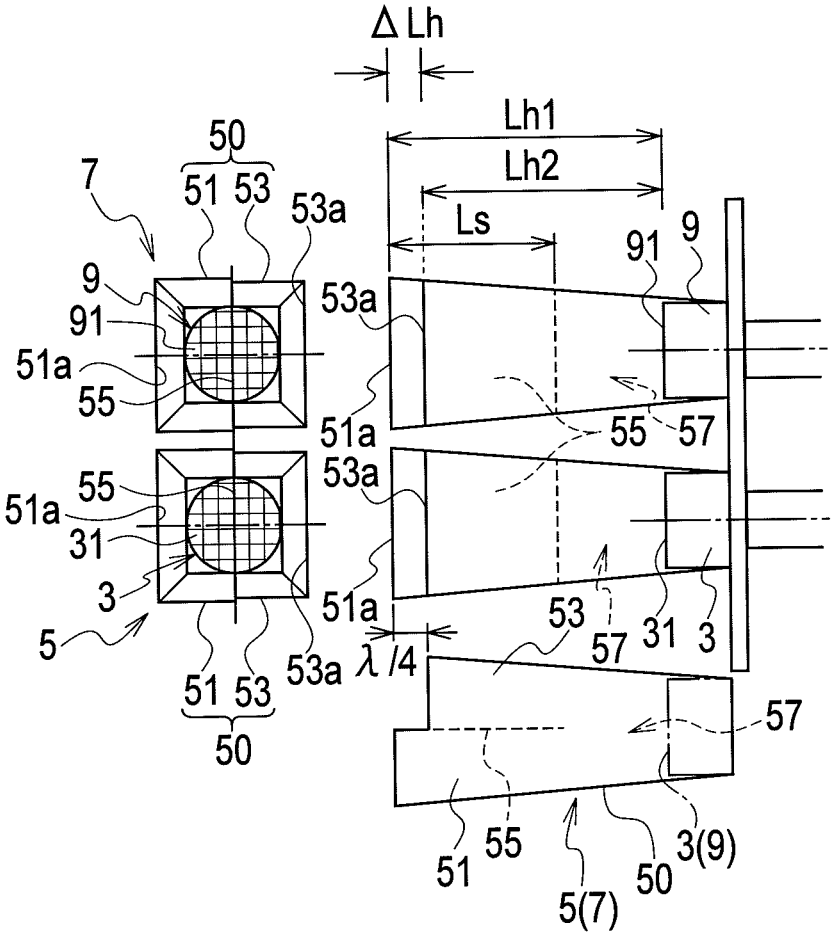
FIG. 13 is an explanatory view showing a schematic configuration of horn enclosures in another example, the horn enclosures forming the transmitting horn and the receiving horn of the ultrasonic sensor of FIG. 2.

Note that the shape of each horn enclosure is not limited to the aforementioned shape having the substantially truncated cone shape as a whole, and may be, for example, other shapes such as a substantially polygonal-pyramid shape. For example, as shown in FIG. 13, square-pyramid shaped horn enclosures 50 may be each formed of two acoustic horn bodies 51, 53 which are divided by a plane extending along a center axis direction of the horn enclosure 50 and which have rectangular cross sections. In this case, the acoustic horn bodies 51, 53 have a dimensional difference $\Delta$Lh (interval)

equal to a quarter of the wavelength λ of the ultrasonic wave U (λ/4) in the propagating direction X of the ultrasonic wave U and the reflected wave R, and the positions of openings 51*a*, 53*a* at front ends of the acoustic horn bodies 51, 53 are shifted from each other by the dimensional difference ΔLh. Note that, as in the acoustic horn bodies 41, 43, the dimensional difference ΔLh between the acoustic horn bodies 51, 53 is not limited to a quarter of the wavelength λ of the ultrasonic wave U (λ/4) and may be any dimension as long as ΔLh=λ×{n+(¼)} (where n is an integer equal to or larger than 0) is satisfied.

Moreover, portions of the two acoustic horn bodies 51, 53 on a side close to the openings 51*a*, 53*a* are partitioned from each other by a screen 55 and form independent acoustic paths. Furthermore, portions of the two acoustic horn bodies 51, 53 on a side close to the transmitting element 3 or the receiving element 9 are not partitioned by the screen 55 and communicate with each other to form a common acoustic space 57.

Also in the common acoustic space 57, from the viewpoint of surely achieving cancellation of the diffracted waves (for example, interference between the diffracted waves A1, A1', A1" and the diffracted wave A2) with opposite phases by the interference therebetween, the dimension (a screen length Ls of FIG. 13) of the common acoustic space 57 in the propagating direction X is preferably set to a dimension equal to or larger than the half-wavelength (λ/2) of the ultrasonic wave U and the reflected wave R.

Effects similar to those exerted by the horn enclosures 40 described above can be obtained by the horn enclosures 50 having such shapes. Note that, when the effective acoustic path of the acoustic horn bodies 51 from the transmitting side to the receiving side is asymmetrical to the effective acoustic path of the acoustic horn bodies 53 from the transmitting side to the receiving side, it is only necessary to adjust the arrangement of the horn enclosures 50 relative to the transmitting element 3 and the receiving element 9.

Figure 14A:
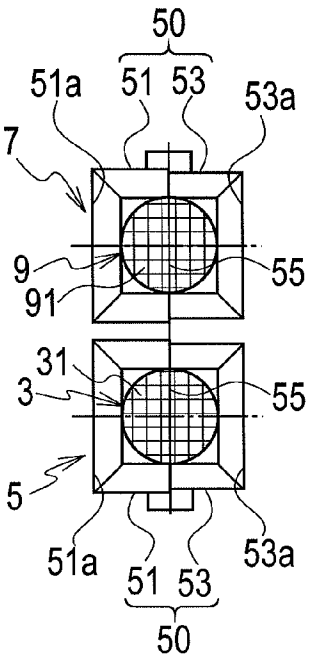
FIGS. 14A to 14E are explanatory views showing adjustment patterns related to symmetric properties of acoustic paths of acoustic horn bodies shown in FIG. 13.
Figure 14B:
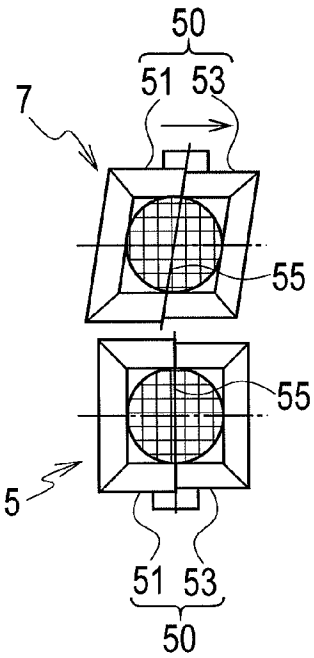
Figure 14C:
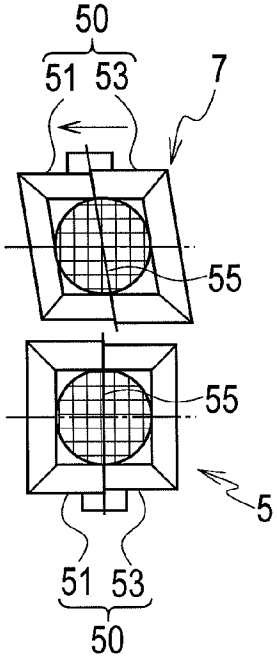
Figure 14D:
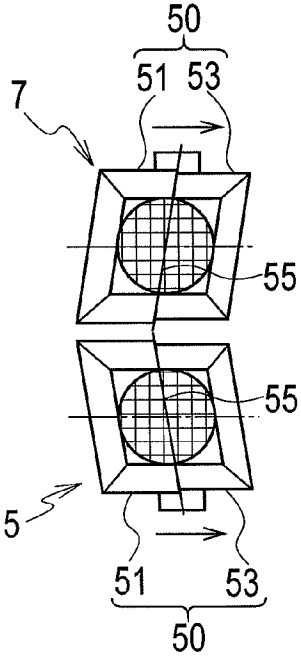
Figure 14E:
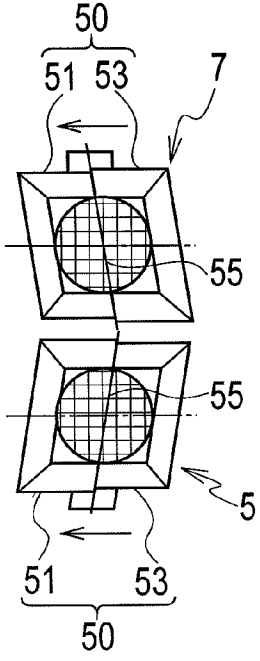

For example, when the arrangement of the horn enclosures 50, 50 on the transmitting side and the receiving side is to be adjusted from a default arrangement in which the screens 55 of both horn enclosures 50, 50 are aligned in a straight line as shown in the explanatory view of FIG. 14A, the adjustment can be performed by deforming only one of the horn enclosures 50 into a shape having parallelogram cross period As shown in FIGS. 14B and 14C, or by deforming both of the horn enclosures 50 into shapes having parallelogram cross sections as shown in FIGS. 14D and 14E.

Note that the configuration for adjusting the arrangement of the horn enclosures 40, 50 relative to the transmitting element 3 and the receiving element 9 may be omitted if the horn enclosures 40, 50 on the transmitting side and the receiving side can be attached to the transmitting element 3 and the receiving element 9 in advance in such a way that the effective acoustic path of the acoustic horn bodies 41, 51 from the transmitting side to the receiving side is symmetrical to the effective acoustic path of the acoustic horn bodies 43, 53 from the transmitting side to the receiving side, and be maintained in this state after the attachment, Moreover, the dimension of the common acoustic space 47, 57 in the propagating direction X can be smaller than the half-wavelength (λ/2) of the ultrasonic wave U and the reflected wave R if the diffracted waves A1, A2 (including the diffracted waves A1', A1") with the opposite phases can be attenuated by the interference to a level equal to or lower than an allowable range.

In the paper discharge device 100 of FIG. 1, the ultrasonic sensor 1 of FIG. 2 described above is used as the ultrasonic sensor 105. The ultrasonic sensor 105 thus includes a transmitting element 105*a*, a transmitting horn 105*b*, a receiving horn 105*c*, and a receiving element 105*d* which respectively have similar configurations as the transmitting element 3, the transmitting horn 5, the receiving horn 7, and the receiving element 9 of the ultrasonic sensor 1 of FIG. 2.

Figure 15:
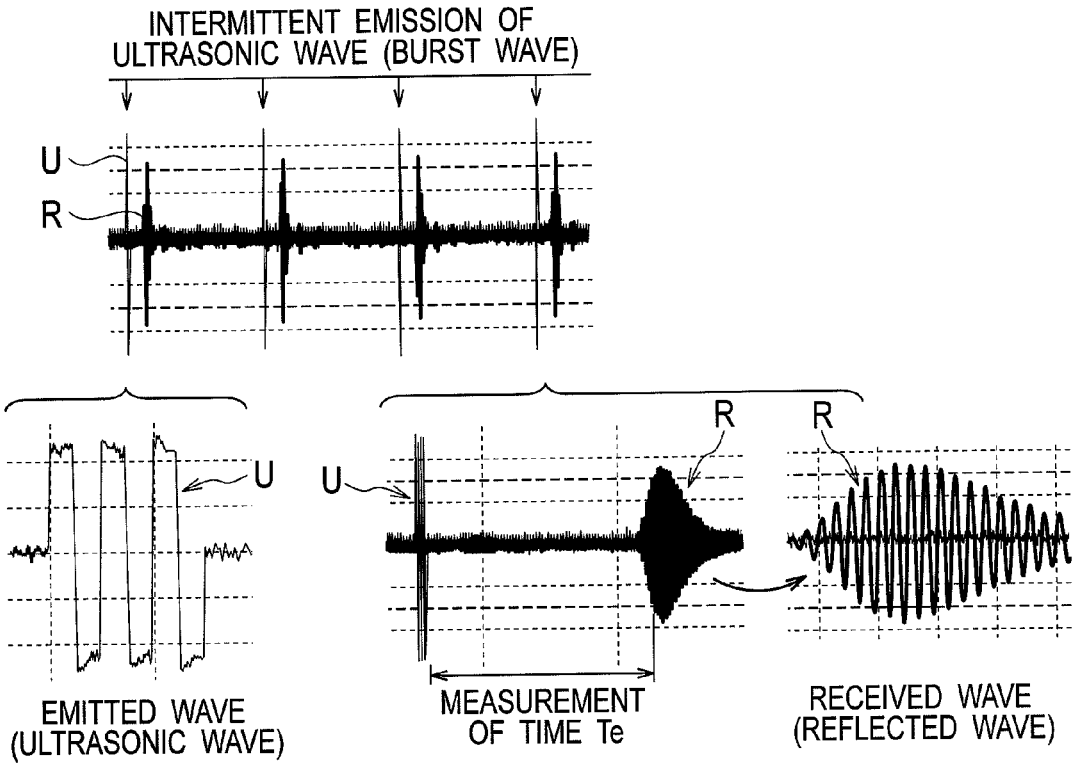
FIG. 15 is an explanatory view showing waveforms of the ultrasonic wave burst-outputted by the ultrasonic sensor of FIG. 1 and the reflected wave from the detection target.

As shown in FIG. 15, the transmitting element 105*a* outputs a burst of the ultrasonic wave U for distance measurement at regular intervals and the receiving element 105*d* receives the reflected wave R from the detection target (not illustrated) after a time corresponding to a round-trip distance to the detection target elapses from the output of the ultrasonic wave U.

As shown in the lower left portion of FIG. 15, the ultrasonic wave U outputted by the transmitting element 105*a* has a shape of an alternating square-wave. Meanwhile, the reflected wave R received by the receiving element 105*d* has a shape of a sine wave whose amplitude increases and then gradually decreases as shown in the lower right portion of FIG. 15. A value obtained by multiplying an elapsed time Te by the speed of sound is the round-trip distance to the detection target, the elapsed time Te being a time elapsed from the output of the ultrasonic wave U at a time point when the amplitude of the reflected wave R increases to a certain level or higher.

Moreover, in the paper discharge device 100 of FIG. 1, the aforementioned control unit 10 of FIG. 2 is used as the state monitor control unit 107. As shown in the block diagram of FIG. 16, the state monitor control unit 107 includes an embedded CPU 111 formed of an integrated circuit, a drive wave generator 113 formed of a discrete circuit, a received wave amplifier 115, and an AM wave (envelope) detector 117.

The drive wave generator 113 generates the drive signal Dr for outputting the ultrasonic wave U in the alternating square wave shape and outputs the generated drive signal Dr to the transmitting element 105*a*. The drive wave generator 113 can be formed of a single-supply H-bridge device which generates an alternating square wave 113*c* (drive signal Dr) from two pulse signals 113*a*, 113*b* with opposite phases.

The received wave amplifier 115 amplifies a sine-wave-shaped received signal from the receiving element 105*d* having received the reflected wave R from the detection target (not illustrated), to a level suitable for a process of detecting the detection target.

The AM wave detector 117 demodulates the amplified received signal to extract an envelope E and outputs a detection signal corresponding to an envelope level. By measuring the elapsed time Te from the output of the ultrasonic wave U at a time point when the level of the detection signal increases to a certain level or higher, it is possible to determine the distance to the detection target to which the ultrasonic wave U to be the reflected wave R is applied. Moreover, comparing the determined distance with the distance to a known detection target can identify the detection target existing in the emitting range (area) of the ultrasonic wave U.

As described above, the ultrasonic wave U from the transmitting element 105*a* driven by the drive signal Dr generated by the drive wave generator 113 is emitted in the prescribed height range (application range RR of the ultrasonic wave U in FIG. 1) including the reference position Href of the top surface position H1 of the stacked paper sheets S on the paper receiving tray 101 and portions above and below the reference position Href. The application range RR of the ultrasonic wave U is a range in which the top surface position H1 of the stacked paper sheets S exists, and includes a position below the reference position Href by a prescribed distance (lowering stroke of the paper receiving tray 101). Accordingly, as shown in the explanatory view of FIG. 17(*a*), the receiving element 105*d* receives at least the reflected wave R from a trailing end Sr (position A) of the stacked paper sheets S in the discharge direction X and the reflected wave R from the end fence 103 (position B) exposed above the top surface of the stacked paper sheets S.

Timings at which the receiving element 105*d* receives the respective reflected waves R differ from each other by an amount corresponding to the difference between the round-trip distance from the ultrasonic sensor 105 to the trailing end Sr of the stacked paper sheets S and that to the end fence 103. Here, in a case where the stacked paper sheets S are sheets with a short dimension between the leading and trailing ends thereof like, for example, "post cards", the round-trip distance from the ultrasonic sensor 105 to the trailing end of the stacked paper sheets S and that to the end fence 103 are not so different from each other. In such a case, as shown by INT in the explanatory view of FIG. 17(*b*), the reception level of the reflected wave R from the end fence 103 starts to increase before the reception level of the reflected wave R from the trailing end Sr of the stacked paper sheets S completely decreases, and the reflected waves R may interfere with each other.

When the preceding reflected wave R from the trailing end Sr of the stacked paper sheets S interferes with the subsequent reflected wave R from the end fence 103, the AM wave detector 117 cannot accurately detect the time point when the detection signal level increases to the certain level or higher, particularly for the subsequent reflected wave R from the end fence 103.

Figure 17:
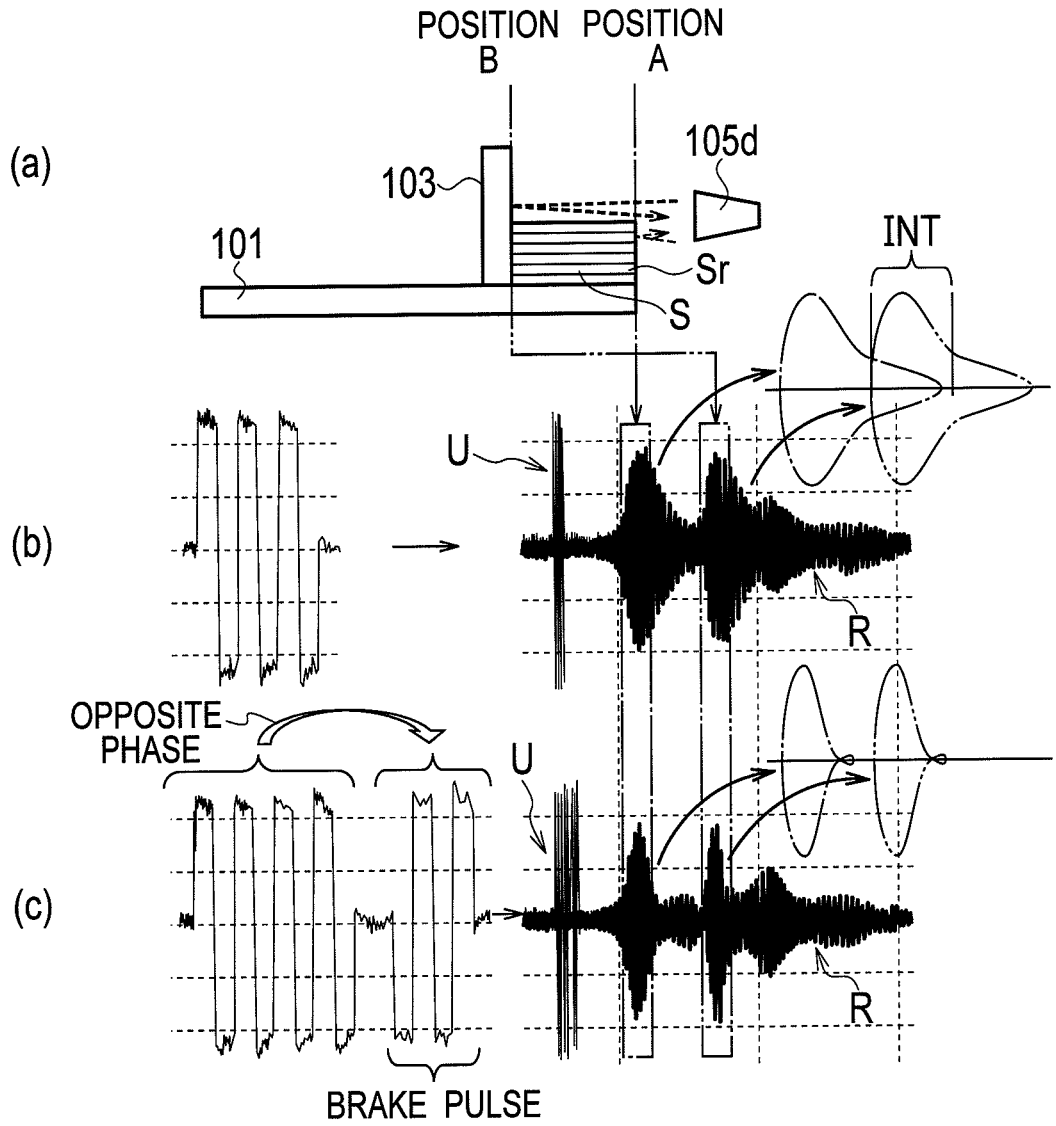
FIG. 17(*a*) to FIG. 17(*c*) are explanatory views showing drive signals for the transmitting element of the ultrasonic sensor which are generated by a drive wave generator of FIG. 16.

To solve this problem, in the embodiment, as shown in the explanatory view of FIG. 17(*c*), an opposite phase pulse portion (brake pulse) is provided in an end portion of the drive signal Dr for the transmitting element 105*a* to accelerate the attenuation of the reflected wave R and the reflected wave R from the trailing end Sr of the stacked paper sheets S and the reflected wave R from the end fence 103 are thus made not to interfere with each other. The AM wave detector 117 can thereby accurately detect the time point when the detection signal level increases to a certain level or higher, also for the subsequent reflected wave R from the end fence 103.

Figure 18:
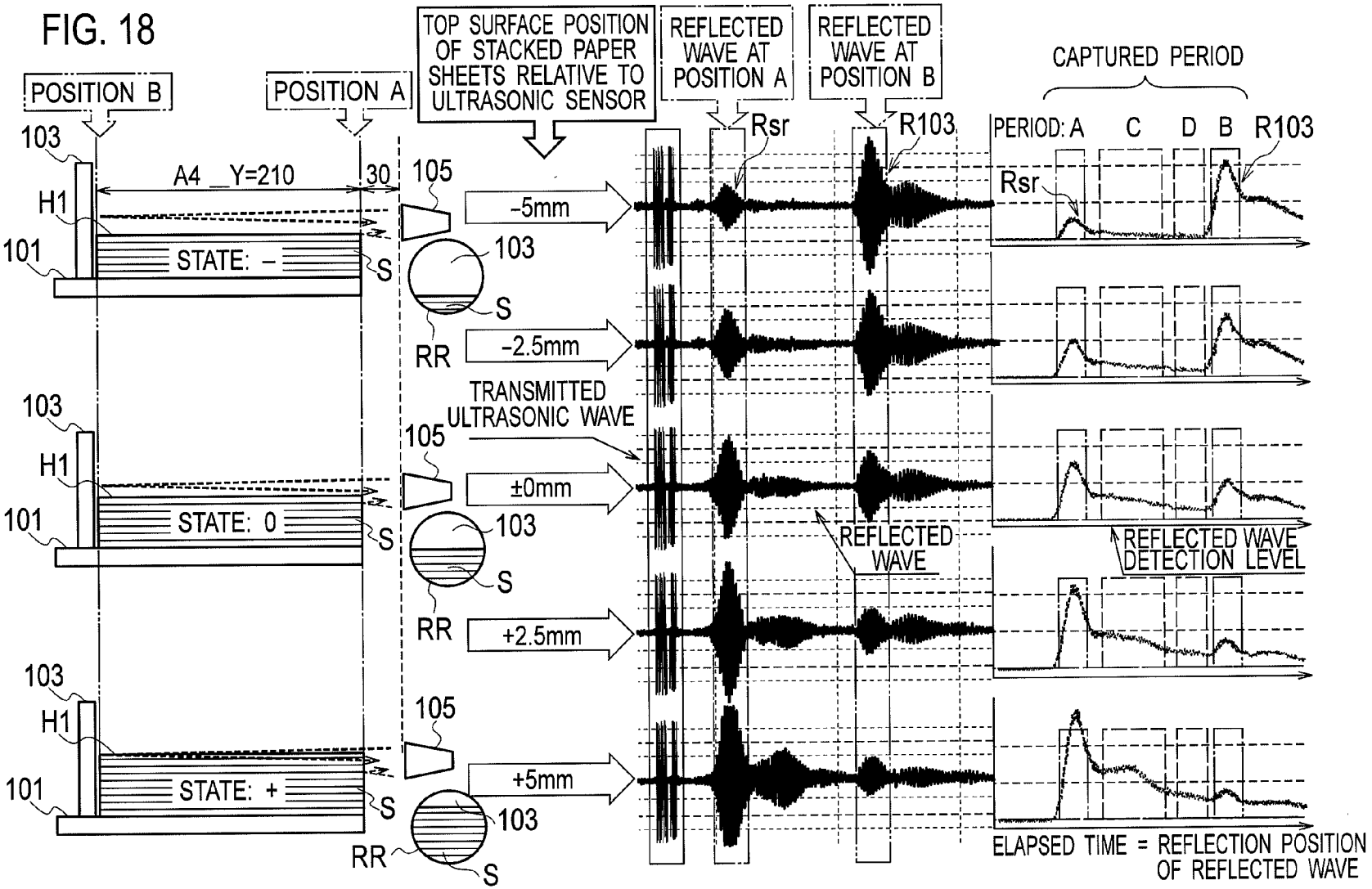
FIG. 18 is an explanatory view showing signal levels of a detection signal of the reflected wave, the signal levels corresponding to respective height positions of a top surface position of stacked paper sheets relative to the ultrasonic sensor of FIG. 1.

The explanatory view of FIG. 18 shows signal waveforms of the detection signals of the reflected wave R which correspond to respective height positions of the top surface position H1 of the stacked paper sheets S relative to the ultrasonic sensor 105. As described with reference to FIGS. 17(*a*) to 17(*c*), the reflected wave R received by the receiving element 105*d* includes a reflected wave component Rsr which is received first from the trailing end Sr of the stacked paper sheets S close to the ultrasonic sensor 105 and a reflected wave component R103 which is received later from the end fence 103 far from the ultrasonic sensor 105. There is a time difference corresponding to the difference in the round-trip distance from the ultrasonic sensor 105 in the discharge direction (horizontal direction) X, between the reflected wave components Rsr, R103.

The signal levels of the reflected wave components Rsr, R103 in the detection signal of the reflected wave R vary depending on the height position of the top surface position H1 of the stacked paper sheets S relative to the ultrasonic sensor 105. This is because a proportion of the ultrasonic wave U emitted by the transmitting element 105*a* of the ultrasonic sensor 105 and applied to each of the trailing end Sr of the stacked paper sheets S and the end fence 103 varies depending on the height position of the top surface position H1 of the stacked paper sheets S relative to the ultrasonic sensor 105.

For example, when the discharge of the paper sheets S to the paper receiving tray 101 proceeds without lowering the paper receiving tray 101, as illustrated in the left portion of FIG. 18, the top surface position H1 of the stacked paper sheets S on the paper receiving tray 101 sequentially changes from a state lower than the reference position Href (state: −) to a state equal to the reference position Href (state: 0), and to a state higher than the reference position Href (state: +). When the top surface position H1 of the stacked paper sheets S sequentially changes to higher positions, the signal level of the reflected wave component Rsr increases while the signal level of the reflected wave component R103 decreases along with the change in the proportion of the ultrasonic wave U applied to each of the trailing end Sr of the stacked paper sheets S and the end fence 103.

The center portion of FIG. 18 shows the signal levels of the reflected wave components Rsr, R103 in a case where the top surface position H1 of the stacked paper sheets S sequentially changes from a position 5 mm below the reference position Href to a position 2.5 mm below the reference position Href, to the same position as the reference position Href, to a the position 2.5 mm above the reference position Href, and to a the position 5 mm above the reference position Href. As shown in FIG. 18, the signal level of reflected wave component Rsr increases as the top surface position H1 of the stacked paper sheets S becomes higher while the signal level of the reflected wave component R103 decreases as the top surface position H1 of the stacked paper sheets S becomes higher. Hence, the top surface position H1 of the stacked paper sheets S can be determined based on the signal levels of the reflected wave components Rsr, R103 in the detection signal of the reflected wave R.

Then, as illustrated in the right portion of FIG. 18, periods A, B in which the reflected wave components Rsr, R103 respectively appear in the detection signal of the reflected wave R are determined based on the round-trip distance between the ultrasonic sensor 105 and the trailing end Sr of the stacked paper sheets S and the round-trip distance between the ultrasonic sensor 105 and the end fence 103. The signal levels of the respective reflected wave components Rsr, R103 can be thereby obtained from the detection signal of the reflected wave R.

Meanwhile, when a jam occurs in the stacked paper sheets S on the paper receiving tray 101, the reflected wave components appearing in the detection signal of the reflected wave R change. Specifically, as shown in the explanatory view of FIG. 19(*a*), in a state (normal state) where there is no jam in the stacked paper sheets S, the reflected wave components Rsr, R103 from the trailing end Sr of the stacked paper sheets S and the end fence 103 appear in the periods A, B in the detection signal of the reflected wave R of the ultrasonic wave U from the ultrasonic sensor 105.

Figure 19:
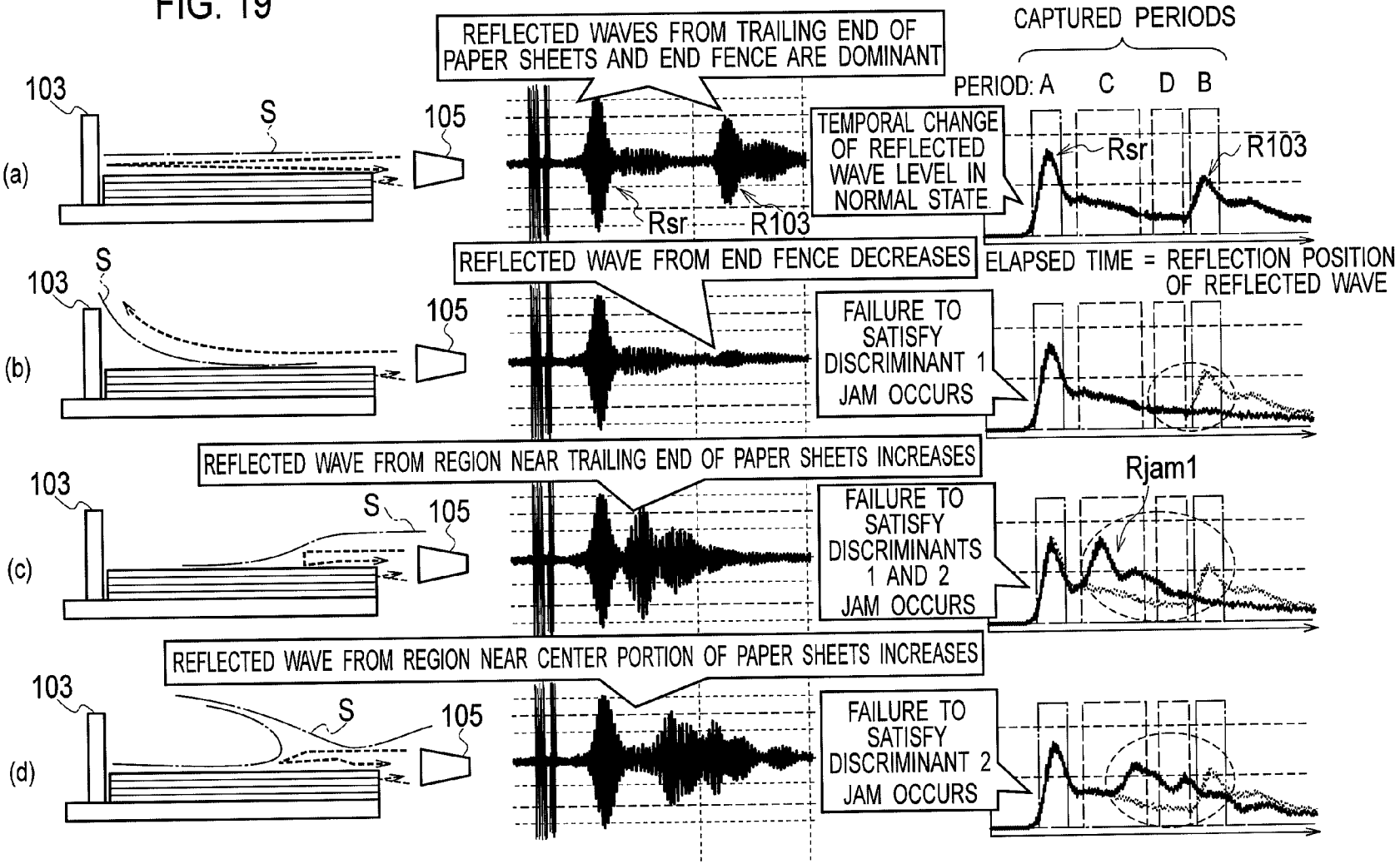
FIG. 19(*a*) to FIG. 19(*d*) are explanatory views showing the signal levels of the detection signal of the reflected wave in a case where there is no jam in the stacked paper sheets of FIG. 1 and in a case where a jam occurs.

However, for example, when a jam in which the leading end of the paper sheet S rides on the end fence 103 occurs as shown in the explanatory view of FIG. 19(*b*) (abnormal state 1), the ultrasonic wave U is blocked by the jammed paper sheet S and is not applied to the end fence 103. Accordingly, only the reflected wave R from the trailing end Sr of the stacked paper sheets S returns to (the receiving element 105*d* of) the ultrasonic sensor 105 and no reflected wave R from the end fence 103 returns to (the receiving element 105*d* of) the ultrasonic sensor 105. Hence, the reflected wave component appearing in the detection signal of the reflected wave R includes only the reflected wave component Rsr from the trailing end Sr of the stacked paper sheets S and no reflected wave component R103 from the end fence 103 appears.

Moreover, for example, when a jam in which the trailing end Sr of the paper sheet S is caught by the discharge port 203 (not illustrated in FIG. 19(*c*)) of the printing device 200 or a similar incident occurs as shown in the explanatory view of FIG. 19(*c*) (abnormal state 2), the ultrasonic wave U is blocked by the jammed paper sheet S and is not applied to the end fence 103. Moreover, a center portion of the jammed paper sheet S in the discharge direction X is spaced above the stacked paper sheets S on a side close to the trailing end Sr of the stacked paper sheets S, and the reflected wave R of the ultrasonic wave U applied to this portion returns to (the receiving element 105*d* of) the ultrasonic sensor 105. Accordingly, in the detection signal of the reflected wave R, not only the reflected wave component Rsr from the trailing end Sr of the stacked paper sheets S appears in the period A, but also a reflected wave component Rjam1 from the jammed paper sheet S appears in a period C between the period A and the period B in a portion closer to the period A.

Furthermore, for example, when a jam in which the paper sheet S rides on the trailing end Sr of the preceding paper sheet S folded upward on the stacked paper sheets S occurs as shown in the explanatory view of FIG. 19(*d*) (abnormal state 3), the ultrasonic wave U is blocked by the paper sheet S folded upward and is not applied to the end fence 103. Moreover, the reflected wave R of the ultrasonic wave U applied to the paper sheet S folded upward and the paper sheet S riding on the folded paper sheet S returns to (the receiving element 105*d* of) the ultrasonic sensor 105. Accordingly, in the detection signal of the reflected wave R, not only the reflected wave component Rsr from the trailing end Sr of the stacked paper sheets S appears in the period A, but also reflected wave components Rjam2, Rjam3 from the paper sheet S folded upward and the paper sheet S riding on the folded paper sheet S appear in the period C and a period D which is closer to the period B than the period C is.

There are various patterns of jams of the paper sheet S other than those described above. However, as is apparent from the examples of FIG. 19(*b*) to FIG. 19(*d*), when a jam of the paper sheet S occurs on the stacked paper sheets S, some kind of signal level change occurs in at least one of the periods B to D in the detection signal of the reflected wave R.

Accordingly, as illustrated in the right portions of FIG. 19(*a*) to FIG. 19(*d*), in addition to the periods A, B, the periods C, D in which the signal level change appears in the detection signal of the reflected wave R when a jam of the paper sheet S occurs are determined based on the round-trip distance between the ultrasonic sensor 105 and the position where the ultrasonic wave U is to be reflected. The signal levels of the reflected wave components Rjam1 to Rjam3 due to a jam of the paper sheet S can be thereby obtained from the detection signal of the reflected wave R.

Figure 16:
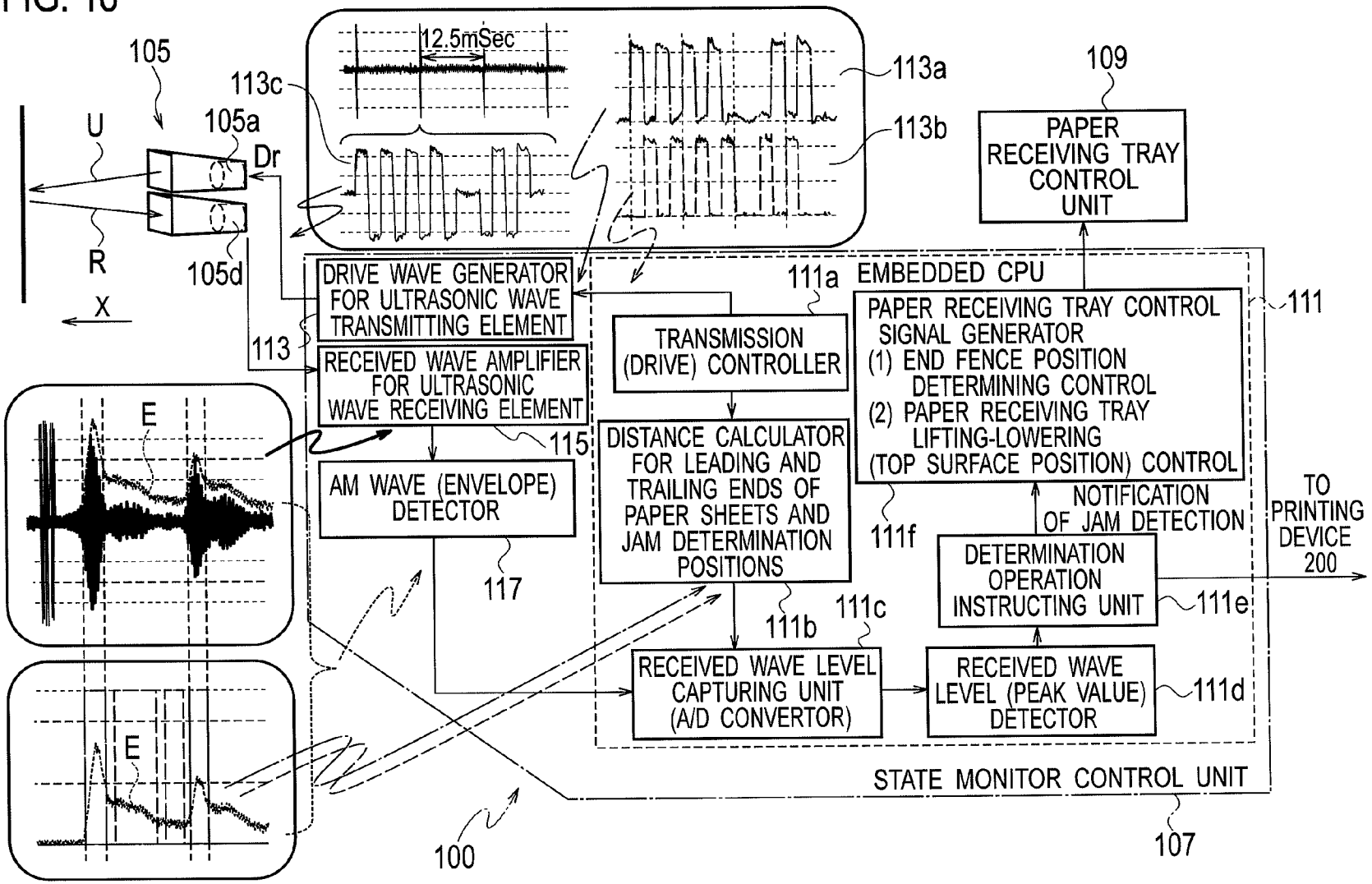
FIG. 16 is a block diagram showing a schematic electrical configuration of the paper discharge device of FIG. 1.

Returning to the description of the configuration of the state monitor control unit 107, as shown in FIG. 16, the embedded CPU 111 implements a transmission (drive) controller 111*a*, a distance calculator 111*b*, a received wave level capturing unit (A/D convertor) 111*c*, a received wave level (peak value) detector 111*d*, a determination operation instructing unit 111*e*, and a paper receiving tray control signal generator 111*f*, by executing a program stored in not-illustrated ROM.

The transmission controller 111*a* controls the transmission of the ultrasonic wave U which is performed by the transmitting element 105*a* of the ultrasonic sensor 105. To perform this control, the transmission controller 111*a* outputs the two pulse signals 113*a*, 113*b* with opposite phases from which the drive signal Dr (alternating square wave 113*c*) is generated, to the drive wave generator 113 in timing with the output of the burst of the ultrasonic wave U.

The distance calculator 111*b* calculates timings (periods A to D in FIG. 16) at which the detection signal of the reflected wave R is sampled to obtain the reflected wave components Rsr, R103, Rjam1, Rjam2, Rjam3, by using, as a reference, the timings at which the transmission controller 111*a* outputs the pulse signals 113*a*, 113*b* to the drive wave generator 113.

The received wave level capturing unit (A/D convertor) 111*c* performs sampling of the periods A to D of the detection signal of the reflected wave R outputted by the AM wave detector 117 at the timings calculated by the distance calculator 111*b* and performs A/D conversion of the samples.

The received wave level (peak value) detector 111*d* detects the peak value in each of the periods A to D in the detection signal of the reflected wave R which have been subjected to the A/D conversion by the received wave level capturing unit 111*c*, and stores the peak value in memory. For example, the memory can be formed of RAM (not illustrated) built into the embedded CPU 111.

The determination operation instructing unit 111*e* determines the top surface position H1 of the stacked paper sheets S existing in the emitting range (area) of the ultrasonic wave U by using (digital values of) the peak values of the respective periods A to D in the detection signal of the reflected wave R which have been detected by the received wave level detector 111*d*, and also determines whether a jam occurs.

Here, the description is given of how the determination operation instructing unit 111*e* performs determination by using the peak values in the detection signal of the reflected wave R.

First, the peak values (AM_Ap [V (volt)], AM_Bp [V]) of the respective periods A, B are used to determine the top surface position H1 of the stacked paper sheets S. At this time, the peak values are multiplied respectively by coefficients Kl_A, Kl_B corresponding to the peak values to correct (or compensate) attenuation amounts of the reflected wave R which correspond to the distance between the ultrasonic sensor 105 and the trailing end Sr of the stacked paper sheets S and the distance between the ultrasonic sensor 105 and the end fence 103.

Note that, in the paper discharge device 100 of the embodiment, the position of the end fence 103 in the discharge direction X is adjusted in such a way that the trailing end Sr of the stacked paper sheets S are at a position 30 mm away from the ultrasonic sensor 105. Accordingly, in the embodiment, the coefficient Kl_A corresponding to the distance between the ultrasonic sensor 105 and the trailing end Sr of the stacked paper sheets S is always set to satisfy Kl_A (30 mm)=1 regardless of the size of the paper sheets S.

Meanwhile, the end fence 103 is located at a position away from the position of the trailing end Sr of the stacked paper sheets S by a distance equal to the dimension of the paper sheets S in the discharge direction X. Accordingly, Kl_B is determined for each size of the paper sheet S. In the embodiment, when the size of the paper sheets S is the A4 horizontal size (dimension in the discharge direction X=210 mm), the coefficient Kl_B corresponding to the distance (30 mm+210 mm) between the ultrasonic sensor 105 and the end fence 103 is set to satisfy Kl_B (240 mm)=1.5. Moreover, when the size of the paper sheets S is the A3 vertical size (dimension in the discharge direction X=420 mm), the coefficient Kl_B corresponding to the distance (30 mm+420 mm) between the ultrasonic sensor 105 and the end fence 103 is set to satisfy Kl_B (450 mm)=2.

The determination operation instructing unit 111*e* multiplies the peak values AM_Ap, AM_Bp of the respective periods A, B by the corresponding coefficients Kl_A, Kl_B described above to calculate a deviation detection voltage AM_ABp [V] corresponding to the distance between the ultrasonic sensor 105 and the top surface position H1 of the stacked paper sheets S, from the following formula.

$$AM_ABp=(AM_Ap\times Kl_A)-(AM_Bp\times Kl_B)$$

Then, the determination operation instructing unit 111*e* determines the top surface position H1 of the stacked paper sheets S from the calculated deviation detection voltage value by using a table, a conversion formula, and the like, as the position relative to the ultrasonic sensor 105.

Figure 20:
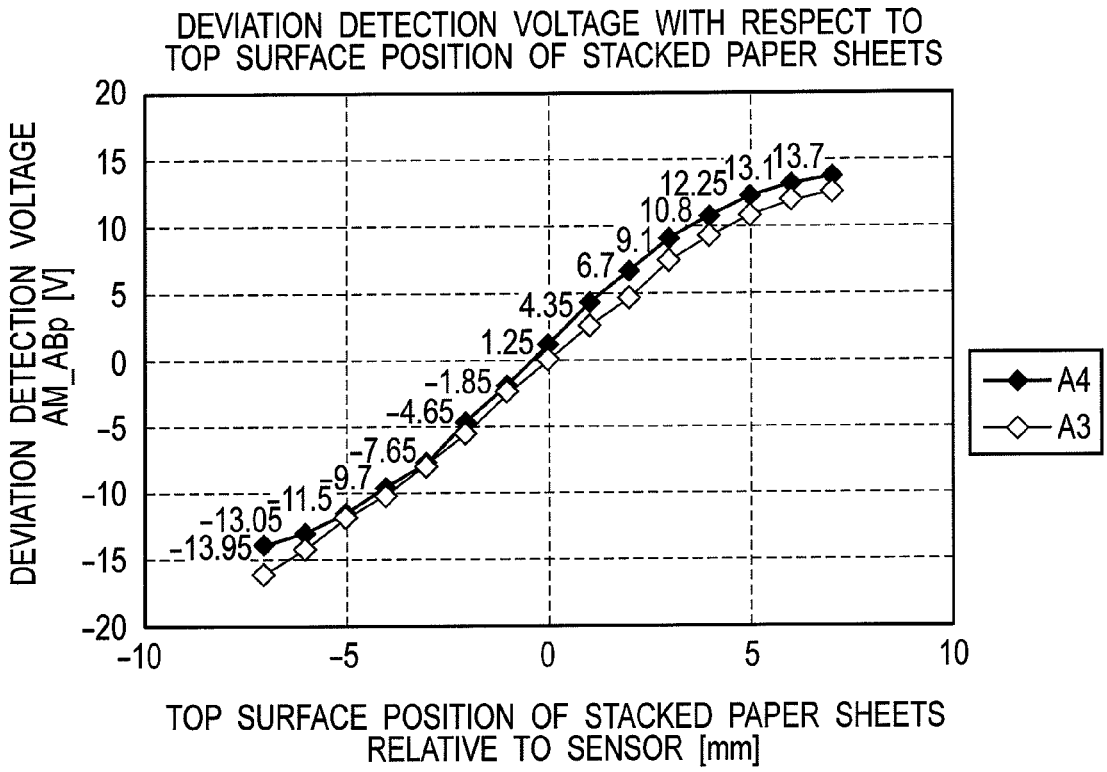
FIG. 20 is a graph showing relationships between a deviation detection voltage value calculated by a determination operation instructing unit of FIG. 16 and an actual measurement value of the top surface position of the stacked paper sheets relative to the ultrasonic sensor, for each size of paper sheet.

FIG. 20 is a graph showing relationships between the deviation detection voltage value calculated by the determination operation instructing unit 111*e* and the actual measurement value of the top surface position H1 of the stacked paper sheets S relative to the ultrasonic sensor 105, for different sizes (A3, A4) of paper sheets S. As shown in this graph, even when the sizes of paper sheets S are different, the values of the deviation detection voltage AM_ABp [V] corresponding to the distance between the ultrasonic sensor 105 and the top surface position H1 of the stacked paper sheets S are almost the same. Hence, the determination operation instructing unit 111*e* can determine the top surface position H1 of the stacked paper sheets S by utilizing the relationships between the top surface position H1 and the deviation detection voltage AM_ABp [V] by generating a table or a conversion formula thereof or by performing a similar operation.

Next, the peak values (AM_Ap [V], AM_Bp [V], AM_Cp [V], AM_Dp [V]) of the respective periods A to D are used to determine the occurrence of jam in the stacked paper sheets S. Specifically, two discriminants are used.

The first discriminant (discriminant 1) is the following formula for discriminating whether the total value of the peak values (AM_Ap [V], AM_Bp [V]) of the respective periods A, B is larger than a determination reference value Cmp_ABp.

if (AM+ABp>Cmp_ABp) "OK" (in a case of True)
else "NG" (in a case of False)
where AM+ABp=AM_Ap+AM_Bp The discriminant 1 described above is used to determine the occurrence of jam because, as described above with reference to FIG. 19(*b*) to FIG. 19(*d*), when a jam occurs in the stacked paper sheets S, no reflected wave component R103 from the end fence 103 appears in the period B of the detection signal of the reflected wave R and the total value of the peak values (AM_Ap [V], AM_Bp [V]) of the respective periods A, B thereby decreases. Accordingly, the determination reference value Cmp_ABp needs to be determined in consideration of this decrease.

The second discriminant (discriminant 2) is the following formula for discriminating whether the total value of the peak values (AM_Cp [V], AM_Dp [V]) of the respective periods C, D is smaller than a determination reference value Cmp_CDp.

if (AM+CDp<Cmp_CDp) "OK" (in a case of True)
else "NG" (in a case of False)
where AM+CDp=AM_Cp+AM_Dp The discriminant 2 described above is used to determine the occurrence of jam because, as described above with reference to FIG. 19(*b*) to FIG. 19(*d*), when a jam occurs in the stacked paper sheets S, the reflected wave components Rjam1 to Rjam3 from the jammed paper sheet S appears in the periods C, D and the total value of the peak values (AM_Cp [V], AM_Dp [V]) of the respective periods C, D thereby increases. Accordingly, the determination reference value Cmp_CDp needs to be determined in consideration of this increase.

Then, the determination operation instructing unit 111*e* determines that "no jam occurs (normal operation)" when it is "OK" in both of the discriminants 1, 2 and determines "jam occurrence" when it is "NG" in at least one of the discriminants 1, 2. When the determination result is "normal operation", the determination operation instructing unit 111*e* notifies the paper receiving tray control signal generator 111*f* of the top surface position H1 of the stacked paper sheets S which has been determined from the deviation detection voltage AM_ABp [V].

Meanwhile, when the determination result is "jam occurrence", the determination operation instructing unit 111*e* notifies a control unit (not illustrated) of the printing device 200 of the occurrence of jam. Hence, it is possible to stop the discharge of the paper sheets S from the discharge port 203 (make the printing device 200 stop the printing operation) and prevent a case where the paper sheet S newly discharged onto the stacked paper sheets S in the paper receiving tray 101 in which the jam is occurring makes the jam more serious.

In the embodiment, the determination reference value Cmp_ABp of the discriminant 1 and the determination reference value Cmp_CDp of the discriminant 2 are set to 12 mm and 10 mm, respectively, assuming that the size of the paper sheet S is the A4 horizontal size (dimension in the discharge direction X=210 mm). The occurrence of jam was discriminated with the discriminants 1, 2 in the states of FIG. 19(*a*) to FIG. 19(*d*), by using the thus-set determination reference values Cmp_ABp, Cmp_CDp, and correct discrimination results were obtained as shown in the explanatory view of FIG. 21.

Note that a situation may occur in which, in the determination of occurrence of jam using the discriminants 1, and 2 described above, the determination result is temporarily "jam occurrence" while the paper sheet S hitting the end fence 103 free-falls and is stacked on the paper receiving tray 101. In view of this, the determination operation instructing unit 111*e* may finally determine that a jam occurs when determining "jam occurrence" a prescribed number of times in series, and then notify the control unit of the printing device 200 and execute similar operations.

Incidentally, the determination by the determination operation instructing unit 111*e* is performed every time the transmitting element 105*a* of the ultrasonic sensor 105 outputs the burst of the ultrasonic wave U. In the case of the paper discharge device 100 of the embodiment, the output interval of the ultrasonic wave U is 12.5 msec. Accordingly, assuming that the discharge speed relative to the paper receiving tray 101 is 800 mm/sec and the discharge interval between the paper sheets S is 40 mm, the output of the ultrasonic wave U and the determination by the determination operation instructing unit 111*e* are each performed 25 times while one paper sheet S (A4 horizontal size, dimension in the discharge direction X=210 mm) is discharged. Hence, there is no problem in terms of operation even if conditions for determining that jam surely occurs include such a condition that the determination operation instructing unit 111*e* determines "jam occurrence" a prescribed number of times in series.

The paper receiving tray control signal generator 111*f* shown in FIG. 16 determines whether the top surface position H1 of the stacked paper sheets S determined by the determination operation instructing unit 111*e* reaches or exceeds the height of the reference position Href. When the top surface position H1 reaches or exceeds the height of the reference position Href, the paper receiving tray control signal generator 111*f* drives the elevator motor 101*a* via the paper receiving tray control unit 109 and lowers the paper receiving tray 101 until the top surface position H1 of the stacked paper sheets S matches with the reference position Href. When the top surface position H1 of the stacked paper sheets S reaches or exceeds the height of the reference position Href after the lowering of the paper receiving tray 101, the paper receiving tray control signal generator 111*f* lowers the paper receiving tray 101 again until the top surface position H1 of the stacked paper sheets S matches with the reference position Href.

This makes it possible to maintain a state where the paper sheet S discharged from the discharge port 203 flies in the discharge direction X until hitting the end fence 103 and then free falls to be stacked with the trailing end thereof aligned with the trailing end Sr of the stacked paper sheets S, even when the number of stacked paper sheets S increases.

Note that the paper receiving tray 101 can be lowered only to a lower limit position which is a home position. Accordingly, when the paper receiving tray 101 reaches the lower limit position during the lowering and this is detected by the lower limit position detector 101*c*, the determination operation instructing unit 111*e* stops the lowering of the paper receiving tray 101 via the paper receiving tray control unit 109. Moreover, the determination operation instructing unit 111*e* instruct the control unit (not illustrated) of the printing device 200 to stop the printing operation and notifies an operator that the stacked paper sheets S on the paper receiving tray 101 is in a full state, in the printing device 200.

As is apparent from the above description, in the paper discharge device 100 of the embodiment, the determination operation instructing unit 111*e* of the embedded CPU 111 obtains the top surface position H1 of the stacked paper sheets S from the deviation detection voltage AM_ABp [V]. Hence, in the embodiment, the state monitor control unit 107 including the embedded CPU 111 is used as a detector configured to detect the top surface position H1 of the stacked paper sheets S.

As described above, in the paper discharge device 100 of the embodiment, the ultrasonic wave U is emitted toward the paper receiving tray 101 from upstream of the paper receiving tray 101 in the discharge direction X of the paper sheets S, in the prescribed height range including the reference position Href of the top surface position H1 of the stacked paper sheets S on the paper receiving tray 101 and the portions above and below the reference position Href. Then, the height position of a boundary between the trailing end Sr of the stacked paper sheets S and the end fence 103 is detected as the top surface position H1 of the stacked paper sheets S on the basis of change in the reception level of the reflected wave R over the elapsed time from the emission of the ultrasonic wave U, the reflected wave R including the reflected wave components Rsr, R103 from the trailing end Sr of the stacked paper sheets S and the end fence 103.

Moreover, the paper discharge device 100 of the embodiment configured as described above can correctly and appropriately detect: the top surface position H1 in the state where the stacked paper sheets S on the paper receiving tray 101 is normally stacked; and the occurrence of jam in the stacked paper sheets S, in a simple way by using one ultrasonic sensor 105. Accordingly, the top surface position H1 of the stacked paper sheets and the occurrence of jam can be detected in simple control without using separate sensors for respective purposes and independently controlling emission of ultrasonic waves and reception of the reflected waves by these sensors.

Moreover, in the paper discharge device 100 of the embodiment, the top surface position H1 of the stacked paper sheets S and the occurrence of jam can be detected by the ultrasonic sensor 105 at the fixed position, regardless of the size of the paper sheets S to be discharged to the paper receiving tray 101. Accordingly, even when the size of the paper sheets S changes and the position of the end fence 103 is moved in the discharge direction X, the top surface position H1 of the stacked paper sheets S and the occurrence of jam can be detected by one ultrasonic sensor 105 in a simple configuration.

Note that the paper discharge device 100 is not limited to the configuration in which the alternating square wave 113*c* generated from the two pulse signals 113*a*, 113*b* with opposite phases is set as the drive signal Dr for causing the transmitting element 105*a* of the ultrasonic sensor 105 to emit the ultrasonic wave U. In other words, the drive signal Dr for the transmitting element 105*a* may be a pulse signal with a single-phase waveform.

However, setting the alternating square wave 113*c* generated from the two pulse signals 113*a*, 113*b* with opposite phases as the drive signal Dr as in the paper discharge device 100 of the embodiment is advantageous because this setting can reduce an excitation vibration period of the transmitting element 105*a* and accelerate the attenuation of the ultrasonic wave U, thereby preventing interference between the reflected waves R from multiple detection targets (the trailing end Sr of the stacked paper sheets S, the end fence 103, and the like) whose round-trip distances are different, as described above.

Moreover, the ultrasonic sensor 105 used to detect the top surface position H1 of the stacked paper sheets S and the occurrence of jam can be utilized for other purposes. For example, the ultrasonic sensor 105 can be used to detect the position of the end fence 103 in the discharge direction X and the lifted-lowered position of the paper receiving tray 101 in initializing operations of the end fence 103 and the paper receiving tray 101.

Description is given of the initializing operations of the end fence 103 and the paper receiving tray 101 which are performed by the paper discharge device 100 by utilizing the ultrasonic sensor 105. For example, the initializing operations are performed under the control of the state monitor control unit 107 and the paper receiving tray control unit 109 when the end fence 103 is moved by the not-illustrated fence motor in the discharge direction X in the start of the printing operation by printing device 200 or the like. Thus, the initializing operations of the end fence 103 and the paper receiving tray 101 are normally performed with no paper sheets S being discharged (stacked) on the paper receiving tray 101.

Figure 22A:
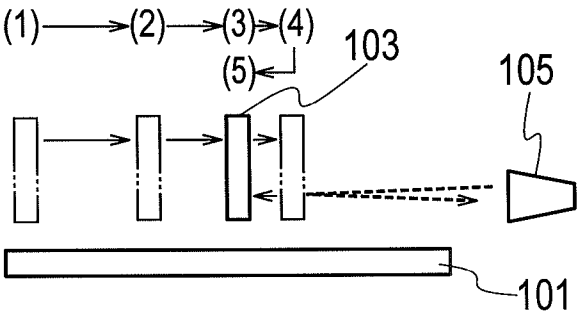
FIGS. 22A to 22E are explanatory views showing an initializing operation of an end fence of FIG. 1 which is performed under the control of a state monitor control unit and a paper receiving tray control unit of FIG. 16.

First, description is given of the initializing operation of the end fence 103 with reference to the explanatory views of FIGS. 22A to 22E. The initializing operation of the end fence 103 is performed in a state where the paper receiving tray 101 is moved to the height position of the home position. As shown in FIG. 22A, the home position of the paper receiving tray 101 is set at such a height position that the ultrasonic wave U from the ultrasonic sensor 105 is applied only to the end fence 103. In the embodiment, the home position of the paper receiving tray 101 is set at such a height that the top surface of the paper receiving tray 101 is located at the height position 15 mm below the lower limit of the prescribed height range in which the ultrasonic sensor 105 emits the ultrasonic wave U.

The paper receiving tray 101 is moved to the home position by the elevator motor 101*a* operating under the control of the paper receiving tray control unit 109 which performs the control while referring to the output of the lower limit position detector 101*c* shown in FIG. 1.

In the initializing operation of the end fence 103, as shown in FIG. 22A, the end fence 103 is moved in the discharge direction X by the fence motor 101*b* from position (1) to position (2), to position (3), to position (4), and then to position (5)=position (3) in this order, and is thereby positioned relative to the ultrasonic sensor 105 in the discharge direction X.

Figure 22B:
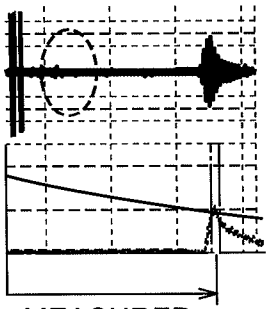
Figure 22C:
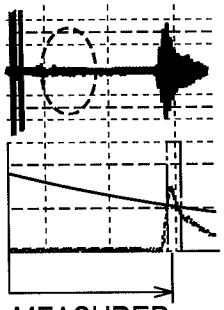
Figure 22D:
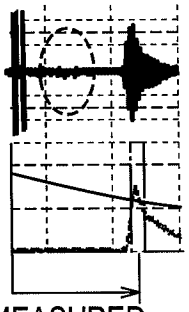
Figure 22E:
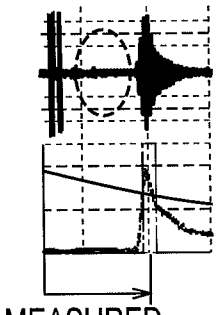

In the case where the size of the paper sheets S is the A4 horizontal size (length in the discharge direction X=210 mm), position (1) of the end fence 103 is a position 450 mm away from the ultrasonic sensor 105 in the discharge direction X, position (2) is a position 340 mm away from the ultrasonic sensor 105 in the discharge direction X, positions (3), (5) are positions 240 mm away from the ultrasonic sensor 105 in the discharge direction X, and position (4) is a position 180 mm away from the ultrasonic sensor 105 in the discharge direction X. Here, position (1) is the position of the end fence 103 corresponding to the size of the A3 vertical paper sheet S, positions (3), (5) are the position of the end fence 103 corresponding to the size of the A4 horizontal paper sheet S, and position (4) is the position of the end fence 103 corresponding to the size of the post-card vertical paper sheet S. FIG. 22B shows a detected waveform at position (1), FIG. 22C shows a detected waveform at position (2), FIG. 22D shows a detected waveform at positions (3) and (5), and FIG. 22E shows a detected waveform at position (4).

As shown in FIGS. 22B to 22E, only the reflected wave component R103 from the end fence 103 appears in the detection signal of the reflected wave R of the ultrasonic wave U emitted from the ultrasonic sensor 105 while the end fence 103 moves in the aforementioned pattern. Hence, in the initializing operation of the end fence 103, the determination operation instructing unit 111*e* of the state monitor unit 107 detects the position of the end fence 103 in the discharge direction X, from a round-trip time t from the output start of the ultrasonic wave U to the reception start of the reflected wave component R103. The paper receiving tray control unit 109 sequentially moves the end fence 103 by using the fence motor 101*a* to positions (1) to (5), on the basis of this detected position.

Next, description is given of the initializing operation of paper receiving tray 101 with reference to the explanatory views of the FIGS. 23A to 23E. The initializing operation of the paper receiving tray 101 is performed after the initializing operation of the end fence 103 is completed.

Figure 23A:
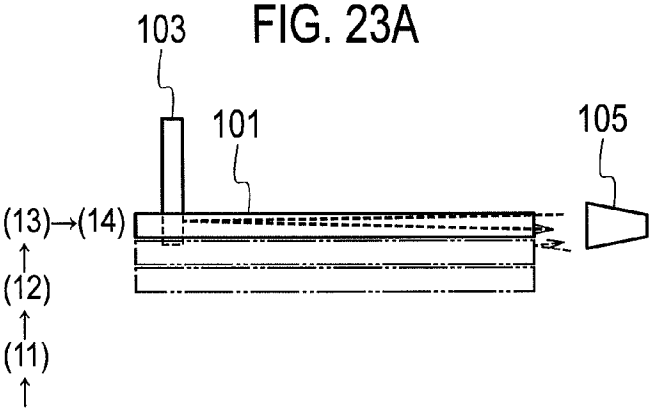
FIGS. 23A to 23E are explanatory views showing an initializing operation of the paper receiving tray of FIG. 1 which is performed under the control of the state monitor control unit and the paper receiving tray control unit of FIG. 16.

As shown in FIG. 23A, in the initializing operation of the paper receiving tray 101, the paper receiving tray 101 is lifted and lowered by the elevator motor 101*a* from the home position (height position 15 mm below the lower limit of the prescribed height range in which the ultrasonic sensor 105 emits the ultrasonic wave U) to position (11), to position (12), to position (13), and to position (14) in this order, and is thereby positioned to a home position relative to the ultrasonic sensor 105 in the lifting-lowering direction.

Figure 23B:
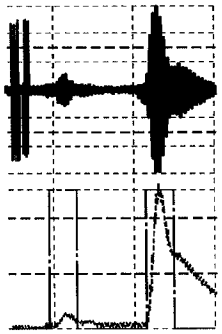
Figure 23C:
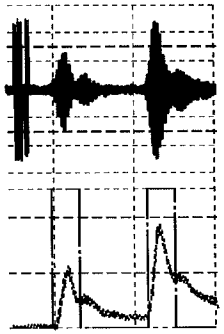
Figure 23D:
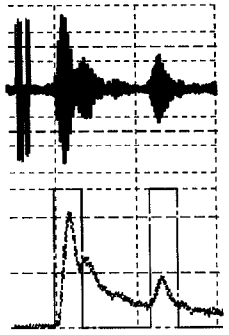
Figure 23E:
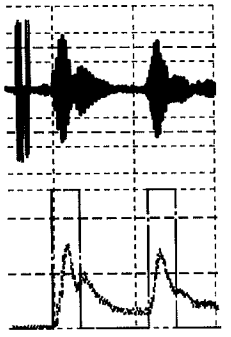

In the embodiment, position (11) of the paper receiving tray 101 is a height position 10 mm below the lower limit of the prescribed height range in which the ultrasonic sensor 105 emits the ultrasonic wave U, position (12) is a height position 2.5 mm below the lower limit, position (13) is a height position 2.5 mm above the lower limit, and position (14) is a height position 0 mm from the lower limit (i.e. is the position of the lower limit of the prescribed height range). FIG. 23B shows a detected waveform at position (11), FIG. 23C shows a detected waveform at position (12), FIG. 23D shows a detected waveform at position (13), FIG. 23E shows a detected waveform at position (14).

As shown in FIGS. 23B to 23E, the reflected wave component R103 from the end fence 103 appears in the detection signal of the reflected wave R of the ultrasonic wave U emitted from the ultrasonic sensor 105 while the paper receiving tray 101 moves from position (11) to position (12) and then to position (14). The peak value of the reflected wave component R103 becomes smallest at position (14) and becomes larger as the paper receiving tray 101 moves away from position (14).

Moreover, as shown in FIG. 23B, almost no reflected wave component R101 from an end (end surface) of the paper receiving tray 101 on the ultrasonic sensor 105 side appears in the detection signal of the reflected wave R when the paper receiving tray 101 is at position (11). However, as shown in FIGS. 23B to 23E, the reflected wave component R101 appears in the detection signal of the reflected wave R when the paper receiving tray 101 is at positions (12) to (14). The peak value of the reflected wave component R101 becomes largest at position (13) and becomes smaller as the paper receiving tray 101 moves away from position (13).

In view of this, in the initializing operation of the paper receiving tray 101, the determination operation instructing unit 111*e* of the state monitor control unit 107 calculates the deviation detection voltage AM_ABp [V] from the formula described above and sets the top surface position H1 of the stacked paper sheets S obtained from the calculated deviation detection voltage AM_ABp [V] as the top surface position of the paper receiving tray 101 (see FIG. 20). The paper receiving tray control unit 109 sequentially moves the paper receiving tray 101 by using the elevator motor 101*a* to positions (11) to (14), on the basis of this top surface position.

As described above, the ultrasonic sensor 105 used to detect the top surface position H1 of the stacked paper sheets S and the occurrence of jam can be more effectively utilized by being used to detect the positions of the end fence 103 and the paper receiving tray 101 in the initializing operations thereof.

Figure 24A:
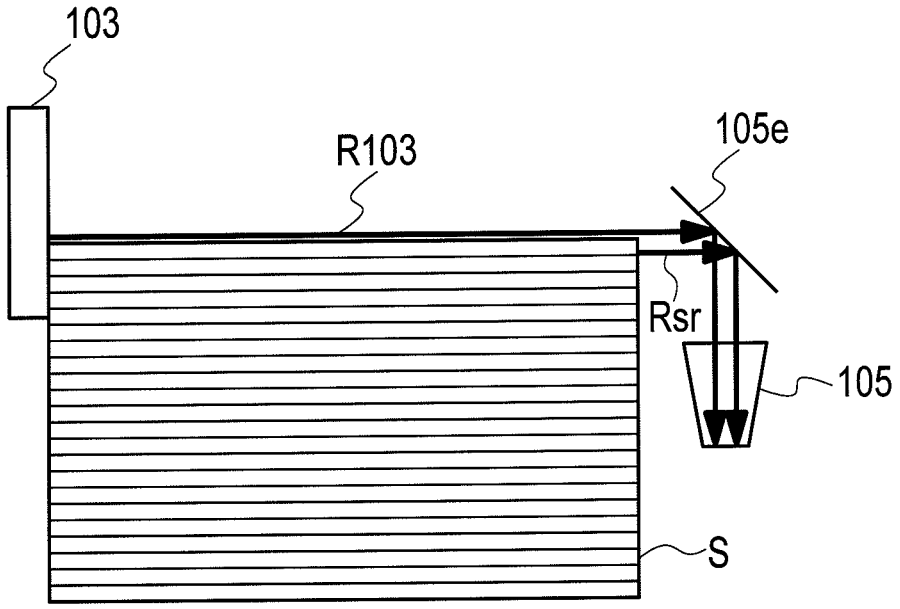
FIG. 24A is an explanatory view showing a case where a reflection plate is arranged on paths of the ultrasonic wave and the reflected wave from and to the ultrasonic sensor of FIG. 2.
Figure 24B:
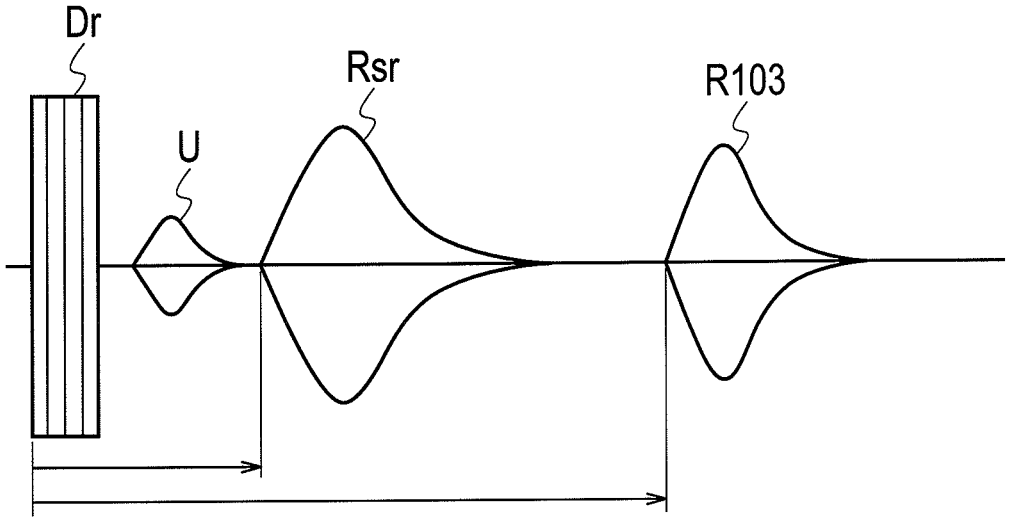
FIG. 24B is a view showing signal levels of reflected waves from a trailing end of the stacked paper sheets and the end fence in a case where the configuration

Moreover, in the embodiment described above, a sensor configured such that the diffracted waves diffracted to travel from the horn enclosure 40 on the transmitting side to the horn enclosure 40 on the receiving side are cancelled out to reduce the shortest detection range is used as the ultrasonic sensor 105 as described with reference to FIGS. 6 to 9. However, for example, as shown in FIG. 24A, the sensor may be configured such that the routes of the ultrasonic wave U and the reflected wave R are extended by a reflection plate 105*e* arranged on the routes of the ultrasonic wave U and the reflected wave R.

Using the reflection plate 105*e* can extend the routes of the ultrasonic wave U and the reflected wave R without arranging the ultrasonic sensor 105 away from the paper receiving tray 101. Moreover, extending the routes of the ultrasonic wave U and the reflected wave R can provide a certain amount of time interval between the output of the ultrasonic wave U from the ultrasonic sensor 105 and the reception of the reflected wave components Rsr, R103 from the trailing end Sr of the stacked paper sheets S and the end fence 103.

Accordingly, the ultrasonic sensor 105 can receive the reflected wave components Rsr, R103 after the effects of the diffracted waves disappear, even if the diffracted waves are not cancelled out. Hence, the ultrasonic sensor 105 which has no function of cancelling out the diffracted waves and in which the shortest detection range is long can be used without increasing the size of the device.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A paper discharge device comprising:

a paper receiving tray on which discharged paper sheets are stacked;

an end fence configured to restrict leading end positions of the paper sheets discharged to the paper receiving tray;

a lift mechanism configured to lower the paper receiving tray by a prescribed distance upon reach of a top surface position of the paper sheets stacked on the paper receiving tray to a reference position;

an ultrasonic sensor configured to emit an ultrasonic wave in a horizontal direction toward the paper receiving tray from upstream of the paper receiving tray in a discharge direction of the paper sheets in a prescribed height range including the reference position and portions above and below the reference position, and to receive a reflected wave from a detection target; and a detector configured to detect the top surface position on a basis of changes in a reception level of the reflected wave over an elapsed time from an emission of the ultrasonic wave, wherein the detector is further configured to detect a distribution of positions of the detection target in the horizontal direction in the prescribed height range on a basis of the changes in the reception level of the reflected wave over the elapsed time from the emission of the ultrasonic wave, and determine whether a jam occurs in the paper sheets stacked on the paper receiving tray on a basis of the detected distribution.

2. The paper discharge device according to claim 1, wherein the detector is configured to determine that the jam occurs in the paper sheets stacked on the paper receiving tray when at least one of the positions of the detection target in the horizontal direction is distributed between a trailing end position of the paper sheets stacked on the paper receiving tray and the end fence in the prescribed height range.

3. The paper discharge device according to claim 2, further comprising a notification unit configured to output a jam notification signal for stopping discharge of the paper sheets, to a printing device configured to discharge the paper sheets onto the paper receiving tray, when the detector determines that the jam occurs in the paper sheets stacked on the paper receiving tray.

4. The paper discharge device according to claim 3, further comprising a reflection plate arranged on routes of the ultrasonic wave and the reflected wave, wherein the ultrasonic sensor is configured to use the reflection plate to emit the ultrasonic wave in the horizontal direction toward the paper receiving tray from upstream of the paper receiving tray in the discharge direction of the paper sheets in the prescribed height range and to receive the reflected wave from the detection target.

5. The paper discharge device according to claim 2, further comprising a reflection plate arranged on routes of the ultrasonic wave and the reflected wave, wherein the ultrasonic sensor is configured to use the reflection plate to emit the ultrasonic wave in the horizontal direction toward the paper receiving tray from upstream of the paper receiving tray in the discharge direction of the paper sheets in the prescribed height range and to receive the reflected wave from the detection target.

6. The paper discharge device according to claim 1, further comprising a notification unit configured to output a jam notification signal for stopping discharge of the paper sheets, to a printing device configured to discharge the paper sheets onto the paper receiving tray, when the detector determines that the jam occurs in the paper sheets stacked on the paper receiving tray.

7. The paper discharge device according to claim 6, further comprising a reflection plate arranged on routes of the ultrasonic wave and the reflected wave, wherein the ultrasonic sensor is configured to use the reflection plate to emit the ultrasonic wave in the horizontal direction toward the paper receiving tray from upstream of the paper receiving tray in the discharge direction of the paper sheets in the prescribed height range and to receive the reflected wave from the detection target.

8. The paper discharge device according to claim 1, further comprising a reflection plate arranged on routes of the ultrasonic wave and the reflected wave, wherein the ultrasonic sensor is configured to use the reflection plate to emit the ultrasonic wave in the horizontal direction toward the paper receiving tray from upstream of the paper receiving tray in the discharge direction of the paper sheets in the prescribed height range and to receive the reflected wave from the detection target.

9. A paper discharge device comprising:

a paper receiving tray on which paper sheets discharged in a horizontal direction are horizontally stacked;

an end fence configured to restrict leading end positions of the paper sheets discharged to the paper receiving tray;

a lift mechanism configured to lower the paper receiving tray by a prescribed distance upon a top surface position of the paper sheets stacked on the paper receiving tray reaching a reference position;

an ultrasonic sensor configured to emit an ultrasonic wave, the ultrasonic wave travelling in a horizontal direction, parallel to the horizontally stacked sheets, toward the paper receiving tray from a position upstream of the paper receiving tray in the horizontal discharge direction of the paper sheets in a prescribed height range including the reference position and portions above and below the reference position, and to receive reflected waves from a detection target; and a detector configured to detect the top surface position of the paper sheets stacked on the paper receiving tray on a basis of both changes in a reception level of the reflected waves from a trailing end position of the paper sheets stacked on the paper receiving tray and changes in a reception level of the reflected wave from at least one position between the trailing end position and the end fence in the prescribed height range over an elapsed time from an emission of the ultrasonic wave.

10. The paper discharge device according to claim 9, the ultrasonic sensor comprising a transmitting horn configured to transmit an ultrasonic wave generated by a transmission element; and a receiving horn configured to cause a reception element to receive a reflection wave from an object detected by the transmitted ultrasonic wave, wherein the transmitting horn and the receiving horn each include a horn enclosure, each horn enclosure comprises two acoustic horn bodies and a screen, each acoustic horn body has an opening and the openings of the acoustic horn bodies are shifted from each other by $\Delta Lh=\lambda(n+1/4)$, where $\Delta Lh$ is a dimensional difference in a propagation direction of the ultrasonic wave, $\lambda$ is the wavelength of the ultrasonic wave and "n" is an integer one of equal to 0 and greater than 0, the two acoustic horn bodies of each horn enclosure are partitioned by the screen of each horn enclosure on a side of each of the openings of the horn bodies, and the screen of each horn enclosure is configured to provide a common sound space in the respective horn enclosure at a side of one of the transmission element and the reception element to allow the two acoustic horn bodies of the associated horn enclosure to communicate with each other at the common sound space.

11. The paper discharge device according to claim 10, wherein the receiving horn of the ultrasonic sensor is configured to receive reflected waves from a trailing end of the stacked paper sheets and from the end fence exposed above a top surface of the stacked paper sheets.

12. The paper discharge device according to claim 9, the detector configured to detect the top surface position of the paper sheets based on an amplitude of the reflected waves.

13. The paper discharge device according to claim 9, wherein the emitted wave is an alternating square wave and the reflected wave is sine wave shaped.

14. A paper discharge device comprising:

a paper receiving tray on which paper sheets discharged in a horizontal direction are horizontally stacked;

an end fence configured to restrict leading end positions of the paper sheets discharged to the paper receiving tray;

a lift mechanism configured to lower the paper receiving tray by a prescribed distance upon a top surface position of the paper sheets stacked on the paper receiving tray reaching a reference position;

an ultrasonic sensor configured to emit an ultrasonic wave from a transmitting element via a transmitting horn, the ultrasonic wave travelling in a horizontal direction, parallel to the horizontally stacked sheets, toward the paper receiving tray from upstream of the paper receiving tray in the horizontal discharge direction of the paper sheets in a prescribed height range including the reference position and portions above and below the reference position, and to receive reflected waves from a detection target with a receiving element via a receiving horn; and a detector configured to detect the top surface position on a basis of changes in reception levels of the reflected waves from a trailing end position of the paper sheets stacked on the paper receiving tray and from at least one position between the trailing end position and the end fence in the prescribed height range over an elapsed time from an emission of the ultrasonic wave.

15. The paper discharge device according to claim 14, the transmitting horn and the receiving horn each include a horn enclosure, each horn enclosure comprises two acoustic horn bodies and a screen, each acoustic horn body has an opening and the openings of the acoustic horn bodies are shifted from each other by $\Delta Lh=\lambda(n+1/4)$, where $\Delta Lh$ is a dimensional difference in a propagation direction of the ultrasonic wave, $\lambda$ is the wavelength of the ultrasonic wave and "n" is an integer one of equal to 0 and greater than 0, the two acoustic horn bodies of each horn enclosure are partitioned by the screen of each horn enclosure on a side of each of the openings of the horn bodies, and the screen of each horn enclosure is configured to provide a common sound space in the respective horn enclosure at a side of one of the transmission element and the reception element to allow the two acoustic horn bodies of the associated horn enclosure to communicate with each other at the common sound space.

16. The paper discharge device according to claim 14, the detector configured to detect the top surface position of the paper sheets based on an amplitude of the reflected waves.

17. The paper discharge device according to claim 14, wherein the emitted wave is an alternating square wave and the reflected wave is sine wave shaped.

18. The paper discharge device according to claim 14, wherein the receiving horn of the ultrasonic sensor is configured to receive reflected waves from a trailing end of the stacked paper sheets and from the end fence exposed above a top surface of the stacked paper sheets.

* * * * *